US008130968B2

(12) United States Patent
Tamaru et al.

(10) Patent No.: US 8,130,968 B2
(45) Date of Patent: Mar. 6, 2012

(54) LIGHT-EMISSION RESPONDER

(75) Inventors: Takuya Tamaru, Hamamatsu (JP); Katsuichi Osakabe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 856 days.

(21) Appl. No.: 12/087,645

(22) PCT Filed: Jan. 11, 2007

(86) PCT No.: PCT/JP2007/050638

§ 371 (c)(1),
(2), (4) Date: Jul. 11, 2008

(87) PCT Pub. No.: WO2007/081052

PCT Pub. Date: Jul. 19, 2007

(65) Prior Publication Data

US 2010/0215182 A1 Aug. 26, 2010

(30) Foreign Application Priority Data

Jan. 16, 2006 (JP) ..... 2006-007244

(51) Int. Cl.
*H04R 29/00* (2006.01)

(52) U.S. Cl. ..... 381/59; 381/56

(58) Field of Classification Search ..... None
See application file for complete search history.

(56) References Cited

U.S. PATENT DOCUMENTS

| | | | | |
|---|---|---|---|---|
| 5,386,478 | A | 1/1995 | Plunkett | |
| 2002/0136414 | A1* | 9/2002 | Jordan et al. | 381/58 |
| 2003/0031333 | A1* | 2/2003 | Cohen et al. | 381/303 |
| 2003/0043051 | A1* | 3/2003 | Shiraishi | 340/825.25 |
| 2006/0210101 | A1* | 9/2006 | Ishibashi et al. | 381/300 |
| 2010/0322435 | A1* | 12/2010 | Suzuki et al. | 381/92 |

FOREIGN PATENT DOCUMENTS

| | | |
|---|---|---|
| JP | 03-181300 | 8/1991 |
| JP | 06-133390 | 5/1994 |
| JP | 06-165297 | 6/1994 |
| JP | 06-233397 | 8/1994 |
| JP | 06-241882 | 9/1994 |
| JP | 10-136498 | 5/1998 |
| JP | 11-331999 | 11/1999 |
| JP | 2001-352600 | 12/2001 |
| JP | 2006-258442 | 9/2006 |
| JP | 2007-068101 | 3/2007 |
| WO | WO 00/70315 | 11/2000 |
| WO | WO 01/67814 | 9/2001 |

* cited by examiner

*Primary Examiner* — Benjamin Sandvik
(74) *Attorney, Agent, or Firm* — Pillsbury Winthrop Shaw Pittman LLP

(57) ABSTRACT

A light-emission responder can respond to input of sound, realizes versatility of response, and can be applied to various use forms. A microphone (110) converts a sound wave into an electric signal. An amplifying section (111) amplifies the electric signal and outputs it to an AGC section (112). The AGC section (112) adjusts the amplitude of the electric signal output from the amplifying section (111). A filter section (113) outputs an electric signal in a frequency band f1 out of the amplitude-adjusted electric signal to a comparing section (114). The comparing section (114) compares the input electric signal with a reference signal. If the voltage of the electric signal passing through the filter section (113) is higher than the reference voltage, the comparing section (114) outputs a signal "H". When a signal "H" is output from the comparing section (114), a drive section (115) allows a light-emitting element (120) to emit light. A light-emission response output section (116) is connected to the drive section (115). When driven by the drive section (115), the light-emission response output section (116) outputs a radio wave of a predetermined frequency.

2 Claims, 19 Drawing Sheets

LIGHT-EMISSION RESPONDER

This application is the National Phase of International Application PCT/JP2007/050638, filed Jan. 11, 2007 which designated the U.S. and that International Application was not published under PCT Article 21(2) in English.

TECHNICAL FIELD

The present invention relates to a light-emission responder that outputs light in response to input sound.

BACKGROUND ART

As a device adapted to output light in response to the input of sound, a sound detector is disclosed in, for example, Japanese Laid-open Patent Publication No. 6-241882. This sound detector includes a microphone for converting input sound into an electrical signal and an amplifier circuit for amplifying the electrical signal. The voltage of the amplified signal is compared with a predetermined reference voltage, and if the signal voltage is higher than the reference voltage, a light emitting diode is lighted. Various applications of the sound detector may be envisaged. For example, the sound detector is attached to a sound source, and light emission from the sound detector is visually observed to find generation timings of sounds. Moreover, the sound detector may be attached to each of a plurality of sound sources. In that case, visual observation of light emission from sound detectors makes it possible to find that sound source from which sound is output.

However, in such an arrangement, since the sound detector disclosed in Japanese Laid-open Patent Publication No. 6-241882 is simply lightened in response to the input of sound, it is only possible to visually confirm whether or not sound generation takes place. Thus, it has been demanded to develop an apparatus which has a variety of forms of use and response.

In consideration of the above circumstances, an object of the present invention is to provide a light-emission responder responding to the input of sound, which is capable of realizing various forms of response and being usable in various forms of use.

DISCLOSURE OF INVENTION

To attain the above object, according to one aspect of this invention, there is provided a light-emission responder comprising a sound pickup section adapted to convert a received sound wave into an electrical signal and output the electrical signal, a level detecting section adapted to detect a level of a signal belonging to a predetermined frequency range out of the electrical signal output from the sound pickup section, a light emitting section adapted to generate visible light or infrared light, a light-emission control section adapted to control a form of light emission of the light emitting section based on the level detected by the level detecting section, and a reply signal output section adapted to output a signal stored in advance, as a reply signal, in accordance with the level detected by the level detecting section, wherein the respective sections are provided in a same housing.

According to a preferred form of this invention, the light-emission responder includes, instead of the light-emission control section and the reply signal output section, a light-emission response control section adapted to control the form of light emission of the light emitting section in accordance with the level detected by the level detecting section such that the visible light or the infrared light is generated in a pattern stored in advance.

According to a preferred form of this invention, the reply signal output section is adapted to output a predetermined radio wave signal as the reply signal.

According to a preferred form of this invention, the light-emission responder includes a light detecting section adapted to detect light, a time measurement section adapted to measure a time period elapsed from when light is detected by the light detecting section to when the electrical signal is output from the sound pickup section, and a distance calculation section adapted to determine a distance to a generation point of the sound wave received by the sound pickup section based on the time period measured by the time measurement section, and the reply signal generating section outputs, as the reply signal, a signal representing the distance calculated by the distance calculation section.

According to a preferred embodiment, the light-emission responder includes a range data receiving section adapted to receive range data representing a frequency range, and a range changing section adapted to change the predetermined frequency range to the frequency range represented by the range data received by the range data receiving section.

According to a preferred form of this invention, a power supply section adapted to supply electric power to the respective sections is provided in the housing.

BEST MODE FOR CARRYING OUT THE INVENTION

Figure 1:
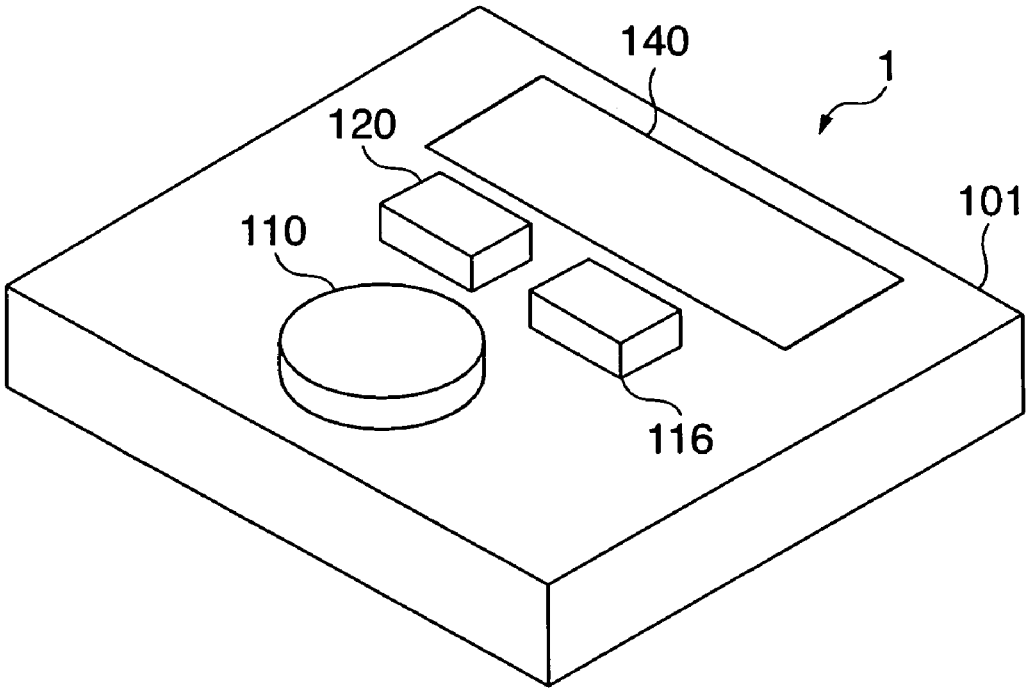
FIG. 1 is an external view of a light-emission responder according to a first embodiment of this invention.
Figure 2:
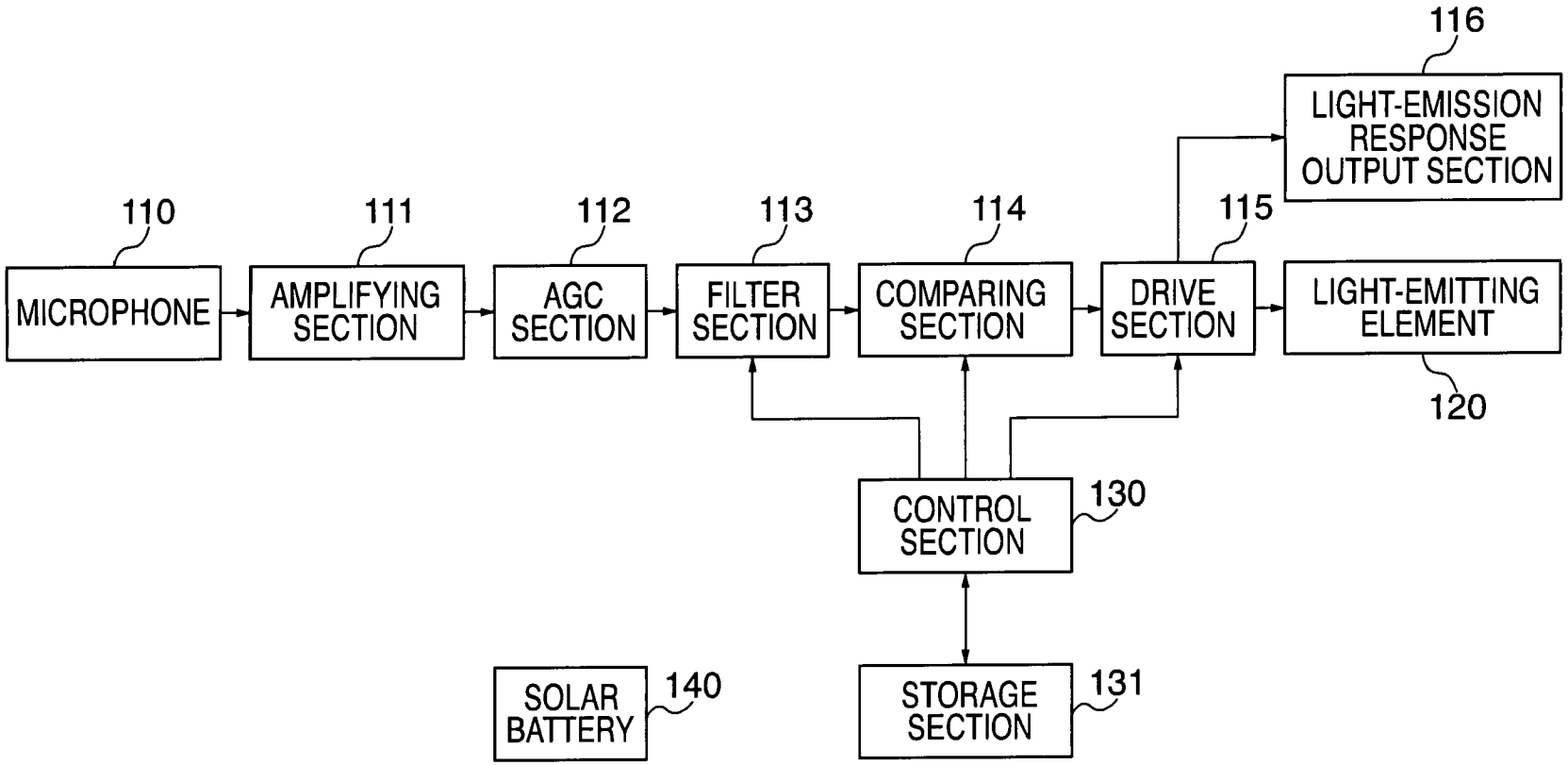
FIG. 2 is a block diagram showing the hardware structure of the light-emission responder in FIG. 1.

FIG. 1 shows in external appearance a light-emission responder 1 according to a first embodiment of this invention, and FIG. 2 shows in block diagram an example of the hardware structure of the light-emission responder 1 in FIG. 1.

As shown in FIG. 1, the light-emission responder 1 includes a housing 101 having a surface thereof on which are disposed a solar battery 140, a light-emitting element 120 that outputs visible light, a light-emission response output section 116, and a microphone 110. In the housing 101, among various blocks shown in FIG. 2, there are incorporated an amplifying section 111, an AGC section 112, a filter section 113, a comparing section 114, a drive section 115, a control section 130, and a storage section 131. Since these blocks are collectively disposed in the housing 101 as described above, the light-emission responder 1 is compact in size which is in the order of several cm or less in width, depth, and height, and light in weight. In this embodiment, these blocks may be incorporated in a one-chip LSI. The light-emission responder 1 has a surface thereof to which a peel-off sticker is affixed and which is opposite to a surface thereof on which the microphone 110 is disposed. Thus, the responder can be adhesively attached to various things.

The control section 130 includes, for example, a one-chip microcomputer, and is adapted to control the filter section 113, the comparing section 114, and the drive section 115 in accordance with a program stored therein. The storage section 131 includes a nonvolatile memory in which are stored frequency range data indicating a frequency range f1 of signals capable of passing through the filter section 113 and reference voltage data indicating a reference voltage for the comparing section 114.

The solar battery 140 is adapted to convert optical energy into electric energy and supply the electric energy to various sections of the light-emission responder 1. The microphone 110 is a silicon microphone, for example, and adapted to convert a sound wave into an electrical signal and output the electrical signal to the amplifying section 111. The amplifying section 111 amplifies the electrical signal output from the microphone 110 and outputs the amplified electrical signal to the AGC (auto gain control) section 112. The AGC section 112 adjusts the amplitude of the electrical signal output from the amplifying section 111 such that the peak of the amplitude is made constant. The amplitude-adjusted electrical signal is output to the filter section 113. Out of the electrical signal output from the amplifying section 111, the filter section 113 outputs, to the comparing section 114, an electrical signal belonging to the frequency range f1 indicated by the frequency data stored in the storage section 131. It should be noted that a frequency range of signals output from the filter section 113 can be changed under the control of the control section 130.

The comparing section 114 includes a comparator circuit, and compares an electrical signal output from the filter section 113 with a reference voltage supplied from the control section 130 to determine whether the voltage of the electrical signal is higher or lower than the reference voltage. An "H (high)" signal is output, if the voltage of the electrical signal passing through the filter section 113 is higher than the reference voltage. If the electrical signal voltage is lower than the reference voltage, an L (low)" signal is output. This binarized electrical signal is supplied to the drive section 115.

The drive section 115 includes a driving circuit adapted to cause the light-emitting element 120 to be lighted. When an "H" signal is output from the comparing section 114, the drive section 115 causes the light-emitting element 120 to be lighted under the control of the control section 130. The light output from the light-emitting element 120 spreads in all the directions centering around the light-emitting element 120, and therefore can reach broad areas.

The light-emission response output section 116 is connected to the drive section 115, and when driven by the drive section 115, outputs a radio wave of a predetermined frequency.

When a sound wave reaches the light-emission responder 1, the sound wave is converted into an electrical signal by the microphone 110. The electrical signal generated by the microphone 110 is amplified by the amplifying section 111, and then output to the AGC section 112. In the AGC section 112, an amplitude adjustment is carried out such that the peak of the amplitude of the input electrical signal is made constant. The electrical signal after the amplitude adjustment is output to the filter section 113. When supplied with the electrical signal, the filter section 113 outputs, to the comparing section 114, an electrical signal belonging to the frequency range f1 indicated by the frequency range data stored in the storage section 131.

In the comparing section 114, the electrical signal output from the filter section 113 is compared with the reference voltage supplied from the control section 130, and whether or not the voltage of the electrical signal is higher or lower than the reference voltage is determined. When the electrical signal is output from the filter section 113 and as a result the level of the electrical signal is raised higher than the reference voltage, an "H" signal is output from the comparing section 114. When the "H" signal is output from the comparing section 114, the drive section 115 causes the light-emitting element 120 to be lighted under the control the control section 130, thereby notifying that a sound wave belonging to the frequency range f1 is input. When the "H" signal is output from the comparing section 114, the drive section 115 drives the light-emission response output section 116. When the light-emission response output section 116 is driven, a radio wave of a predetermined frequency is output from the light-emission response output section 116. When an "L" signal is output from the comparing section 114, the drive section 115 causes the light-emitting element 120 to be extinguished. When the "L" signal is output from the comparing section 114, the light-emission response output section 116 is stopped from being driven.

As described above, when a sound wave belonging to the frequency range f1 is input to the light-emission responder 1, light is automatically output to notify that the sound wave belonging to the predetermined frequency range f1 is input. Since the light is output from the light-emission responder 1 as a reply signal to the input of sound, various observations such as sound generation timing observations and sound generation position observations can be made by visual observation of the light.

When a sound wave belonging to the frequency range f1 is input to the light-emission responder 1, a radio wave is automatically output to notify that the sound wave belonging to the frequency range f1 is input. Since the radio wave of a predetermined frequency is output from the light-emission responder 1 as a reply signal to the input of sound, various observations such as sound generation timing observations and sound generation position observations can be made by a receiver by detecting the radio wave.

It should be noted that the light-emission responder 1 may include the light-emission response output section 116 configured not to output a radio wave but to output a sound wave. In the case of outputting a sound wave, a sound wave may be output in a particular pattern or a sound wave of a predetermined frequency may be output for a given length of time at a predetermined cycle.

In the case of outputting a sound wave, it is preferable that a sound wave of a frequency range hardly used for an ordinary audio signal should be output. In the light-emission responder 1, an amount of light output from the light-emitting element 120 may be controlled in accordance with the level of a signal output from the filter section 113. Moreover, in the light-emission responder 1, the comparing section 114 may be configured to output an "H" signal when the level of an electrical signal output from the filter section 113 is higher than the reference voltage for a given length of time. In that case, light emission does not take place in response to instantaneous input of sound other than sounds to be observed.

Figure 3:
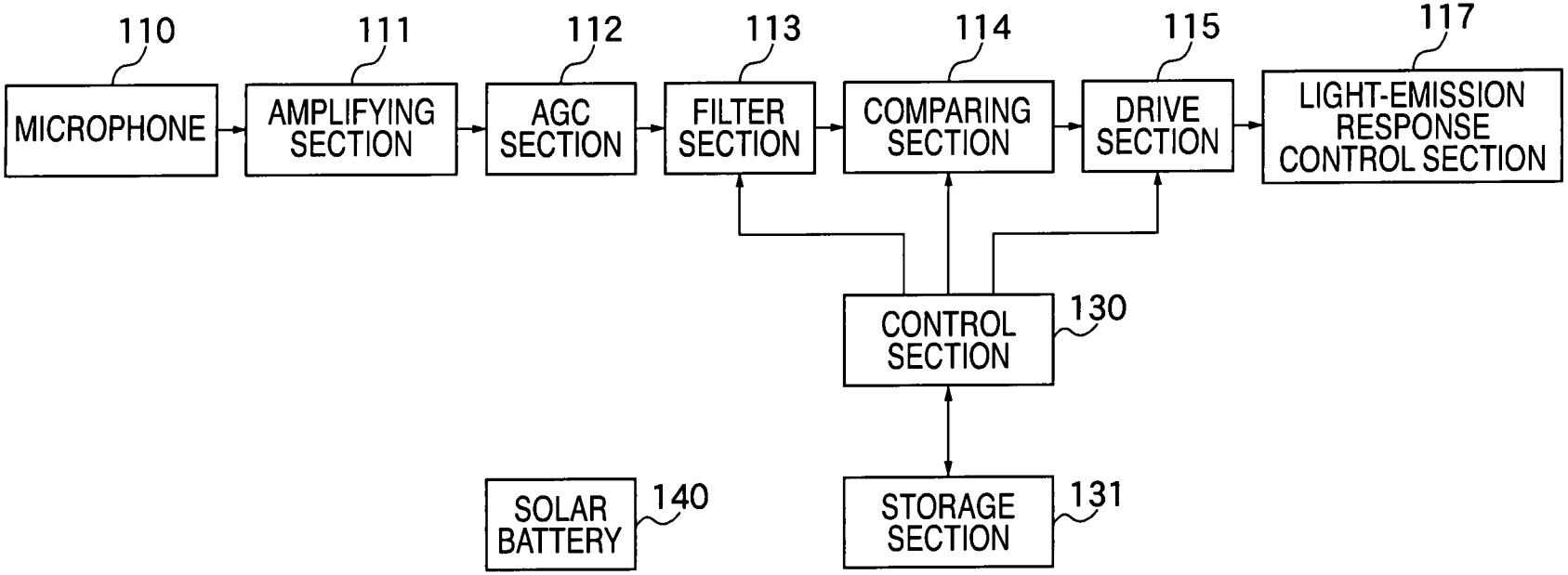
FIG. 3 is a view showing an example of the hardware structure of a light-emission responder according to a second embodiment of this invention.

FIG. 3 shows an example of the hardware structure of a light-emission responder 100 according to a second embodiment of this invention.

As shown in FIG. 3, the light-emission responder 100 differs from the light-emission responder 1 of the first embodiment in that it does not include the light-emission response output section 116 but includes a light-emission response control section 117. The control section 117 includes the light-emitting element 120 (not shown), and is adapted to output light. With regard to parts other than the light-emission response control section 117, the construction is the same as those of the first embodiment and therefore a description thereof will be omitted.

Figure 4:
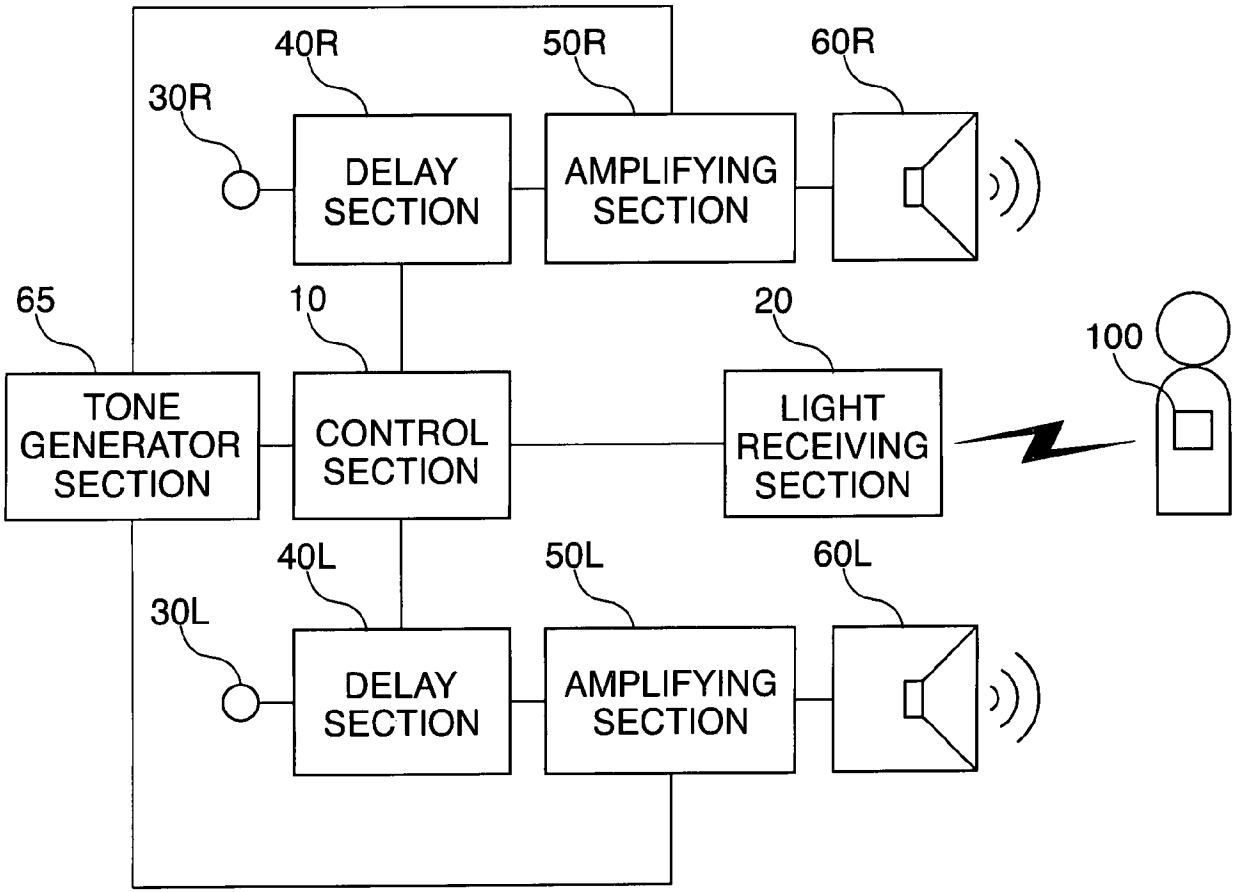
FIG. 4 is a view showing an example of the whole construction of a system in which the light-emission responder in FIG. 3 is utilized.

FIG. 4 shows an example of the whole construction of a system in which the light-emission responder 100 in FIG. 3 is utilized. In this system, the light-emission responder 100 is affixed to a listener.

An input terminal 30L is supplied with a left-channel audio signal, and an input terminal 30R is supplied with a right-channel audio signal. The audio signal input to the input terminal 30L is supplied to a delay section 40L, and the audio signal input to the input terminal 30R is supplied to a delay section 40R. Each of the delay sections 40L and 40R includes a circuit for delaying an audio signal, causes an input audio signal to be delayed by a time instructed by the control section 10, and outputs the delayed signal. The audio signal output from the delay section 40L is input to an amplifying section 50L, and the audio signal output from the delay section 40R is input to an amplifying section 50R. Each of the amplifying sections 50L and 50R amplifies the input audio signal, and outputs the amplified audio signal to a speaker connected thereto. A speaker 60L is connected to the amplifying section 50L, and a speaker 60R is connected to the amplifying section 50R. Each speaker converts the audio signal output from the amplifier connected thereto to a sound wave. The light receiving section 20 includes an optical sensor, and converts received light into an electrical signal and outputs the electrical signal to the control section 10. A tone generator section 65 is connected to the control section 10 and the amplifying sections 50L, 50R. Under the control of the control section 10, the tone generator section 65 outputs an audio signal belonging to a frequency range which is the same as the frequency range f1 indicated by the frequency range data stored in the storage section 131 to the amplifying section 50L or 50R.

The control section 10 includes a CPU (central processing unit), a ROM (read only memory), a RAM (random access memory), a nonvolatile memory, etc. When a program stored in the ROM is implemented by the CPU, various sections connected to the control section 10 are controlled by the control section 10. The control section 10 implements the processing which is shown by way of example in FIG. 5, and achieves a function of identifying a position of the light-emission responder 100 based on distances between the speaker 60L and the light-emission responder 100, between the speaker 60R and the light-emission responder 100, and between the speakers 60L and 60R, and a function of changing the directivity direction of sound waves output from the speakers in accordance with the identified position.

Figure 5:
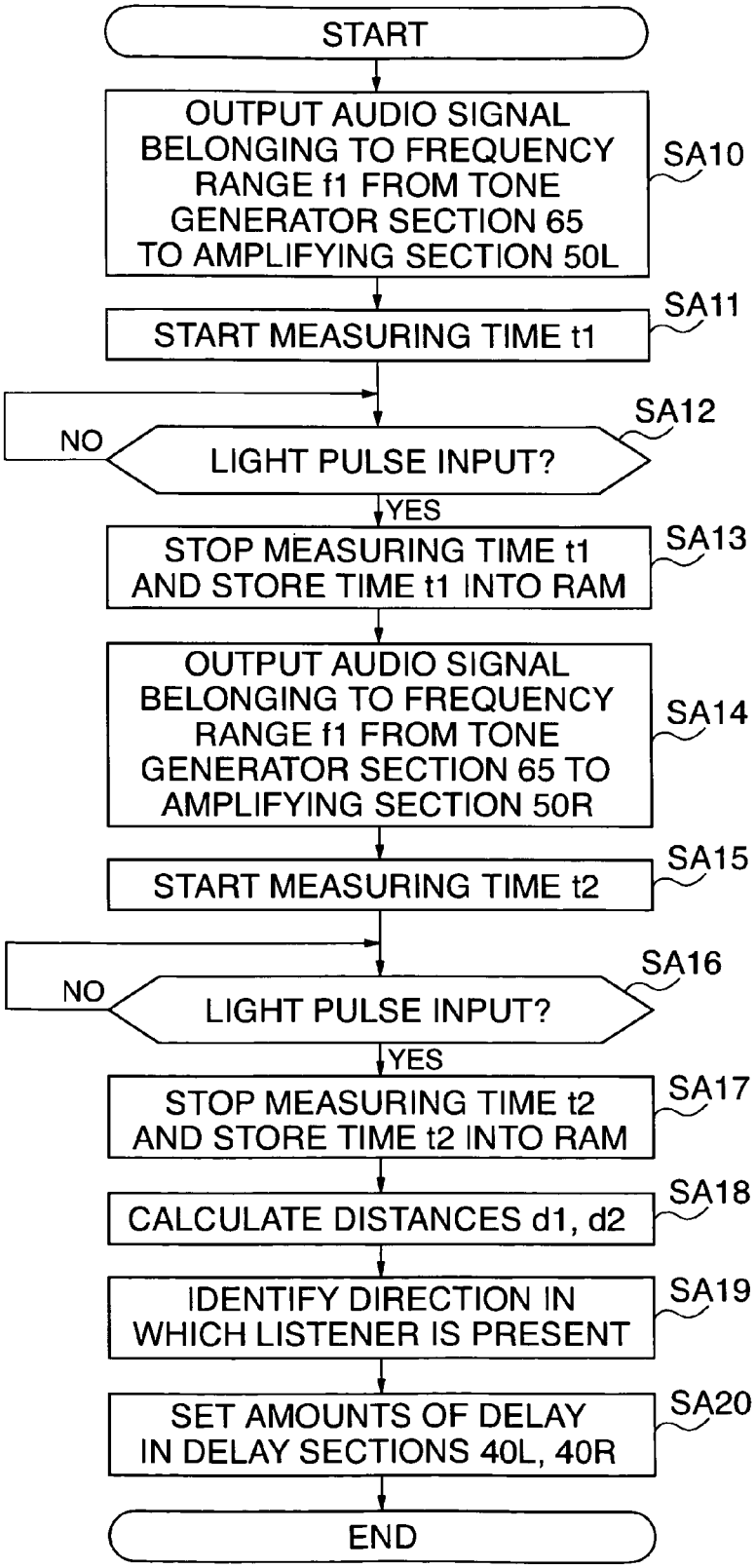
FIG. 5 is a flowchart of processing implemented by a control section of the system in FIG. 4.

Next, with reference to FIG. 5, operations of the light-emission responder of the second embodiment of this invention will be explained. FIG. 5 shows in flowchart the processing implemented by the control section of the system in FIG. 4. In the following, a description will be given of operations in a case where the distance d0 between the speakers 60L, 60R is stored in the nonvolatile memory of the control section 10.

Referring to FIG. 5, the control section 10 controls the tone generator section 65 to output, to the amplifying section 50L, an audio signal belonging to a frequency range which is the same as the frequency range f1 indicated by the frequency range data stored in the storage section 131 (step SA10). The control section 10 starts measuring a time t1 elapsed from when the audio signal is output to the amplifying section 50L (step SA11). The audio signal output from the tone generator section 65 is amplified by the amplifying section 50L and output to the speaker 60L. The speaker 60L outputs a sound wave having a frequency corresponding to that of the supplied audio signal.

When the sound wave output from the speaker 60L reaches the light-emission responder 100 worn by the listener, an "H" signal is output from the comparing section 114 as in the case of the light-emission responder 1 of the first embodiment. When the "H" signal is output from the comparing section 114, the drive section 115 causes, under the control of the control section 130, the light emitting element of the light-emission response control section 117 to be lighted for output of a light pulse.

The light pulse output from the light-emission response control section 117 reaches the light receiving section 20. The light output from the light-emission response control section 117 spreads centering around the light-emission response control section 117, and reaches the light receiving section 20, even if the light-emission response control section 117 is not directed to the light receiving section 20. When the light pulse reaches the light receiving section 20, the light reaching the light receiving section 20 is converted into an electrical signal, which is output to the control section 10. When the electrical signal representing the light pulse is output from the light receiving section 20 and input to the control section 10 (YES to step SA12), the control section 10 stops measuring the time t1 elapsed from when the audio signal is output to the amplifying section 50L, and stores the measured time t1 into the RAM (step SA13).

Next, the control section 10 controls the tone generator section 65 such that the audio signal belonging to the frequency range f1 is output from the tone generator section 65 to the amplifying section 50R (step SA14). The control section 10 starts measuring a time t2 elapsed from when the audio signal is output to the amplifying section 50R (step.

SA15). The audio signal output from the tone generator section 65 is amplified by the amplifying section 50R and then input to the speaker 60R. The speaker 60R outputs a sound wave having a frequency that is the same as the frequency of the supplied audio signal.

When the sound wave output from the speaker 60R reaches the light-emission responder 100, a light pulse is output from the light-emission response control section 117 in the light-emission responder 100, as in the case when the sound wave output from the speaker 60L reaches the light-emission responder 100.

When the light pulse reaches the light receiving section 20, the light reaching the light receiving section 20 is converted into an electrical signal, and the electrical signal is output to the control section 10. When the electrical signal representing the light pulse is output from the light receiving section 20 and input into the control section 10 (YES to step SA16), the control section 10 stops measuring the time t2 elapsed from when the audio signal is output to the amplifying section 50R, and stores the measured time t2 into the RAM (step SA17).

Next, the control section 10 multiplies the time t1, i.e., the time period elapsed from when the sound wave is output from the speaker 60L to when the sound wave reaches the light-emission responder 100, by the sound velocity to determine a distance d1 from the speaker 60L to the light-emission responder 100. The control section 10 multiplies the time t2, i.e., the time period from when the sound wave is output from the speaker 60R to when the sound wave reaches the light-emission responder 100, by the sound velocity to determine a distance d2 from the speaker 60R to the light-emission responder 100 (step SA18). If the distances d1, d2 are determined, the lengths of the sides of a triangle having vertices at the light-emission responder 100, the speaker 60L, and the speaker 60R can be determined since the distance d0 between the speakers 60L, 60R is stored beforehand in the control section 10.

If the lengths of the sides of the triangle are determined, the interior angles of the triangle can be determined in accordance with cosine law, and the position of the light-emission responder 100 can be determined from the determined interior angles. Based on the distances d0, d1, and d2, the control section 10 determines the angle formed between the side connecting the speakers 60L, 60R and the side connecting the speaker 60L and the light-emission responder 100. Based on the distances d0, d1, and d2, the control section 10 determines the angle formed between the side connecting the speakers 60L, 60R and the side connecting the speaker 60R and the light-emission responder 100. After determining these angles, the control section 10 identifies the direction of the light-emission responder 100 as viewed from the speakers 60L, 60R, i.e., indentifies the direction in which a listener is present (step SA19).

After identifying the direction in which the listener is present, the control section 10 controls the delay sections 40L, 40R to generate a time difference between audio signals respectively input into the input terminals 30L, 30R such that the directivity direction of a sound wave output from the speaker system becomes coincident with the direction in which the listener is present (step SA20). When amounts of delay in the delay sections 40L, 40R are set, the directivity direction of a sound wave output from the speaker system coincides with the direction of the light-emission responder 100, i.e., the direction of the listener. The control section 10 always detects the position of the listener by performing the processing in the steps SA10 to SA20 at a predetermined cycle, and controls the directivity direction of sound output from the speaker system in accordance with the detected position.

As a result, an optimum acoustic field can be obtained without the need for the listener to adjust the positions of the speakers 60L, 60R. In addition, even if the listener moves during the audio signal reproduction, the directivity direction of sound output from the speaker system is changed toward the direction of the listener, and therefore the optimum acoustic field for the listener can be obtained. In the present system, the light output from the light-emission responder 100 is not narrow in directivity, but rather spreads in all the directions from the light-emission response control section 117. Therefore, without the need of paying attention to the direction of the light-emission response control section 117, the light pulse output from the light-emission response control section 117 reaches the light receiving section 20, and the position of the listener can easily be identified without requiring the listener to carry out a laborious task. Furthermore, the light-emission responder 100 is compact in the order of several cm and light in weight, and can be affixed to the clothes of the listener. Thus, the position of the listener can be detected, and a satisfactory acoustic field can be obtained without requiring the listener to perform a laborious task.

In this system, the light-emission responder 100 is adapted to be driven by the solar battery 140. In the case of a primary battery or a secondary battery being used, the battery weight makes the light-emission responder 100 heavy, and the responder becomes unsuitable for being attached to clothes. On the other hand, in this system driven by the solar battery 140, the light-emission responder 100 becomes light in weight and can easily be attached to clothes. Moreover, there is a low possibility of occurrence of an erroneous operation since the control section 10 does not control the delay sections 40R, 40L when simply lighted light is input into the light receiving section 20. It should be noted that in this embodiment, the form of light pulse output from the light emitting element may be differentiated in accordance with the level of a signal output from the filter section 113.

In this embodiment, the light-emission responder 100 may include a light-emission response output section 116. When a sound wave from the speaker 60R or 60L is input into the light-emission responder 100, a radio wave may be output from the light-emission response output section 116, with the light emitting element being simply lighted. A radio wave receiving section for receiving a radio wave may be connected to the control section 10 to receive a radio wave output from the light-emission responder 100, and a time period from when the sound wave is output to when the radio wave is received may be measured to identify the position of the listener.

Next, a description will be given of a light-emission responder according to a third embodiment of this invention. The third embodiment differs from the above described embodiments in that the light-emission responder determines distances to the respective speakers and notifies the determined distances to the control section 10.

Figure 6:
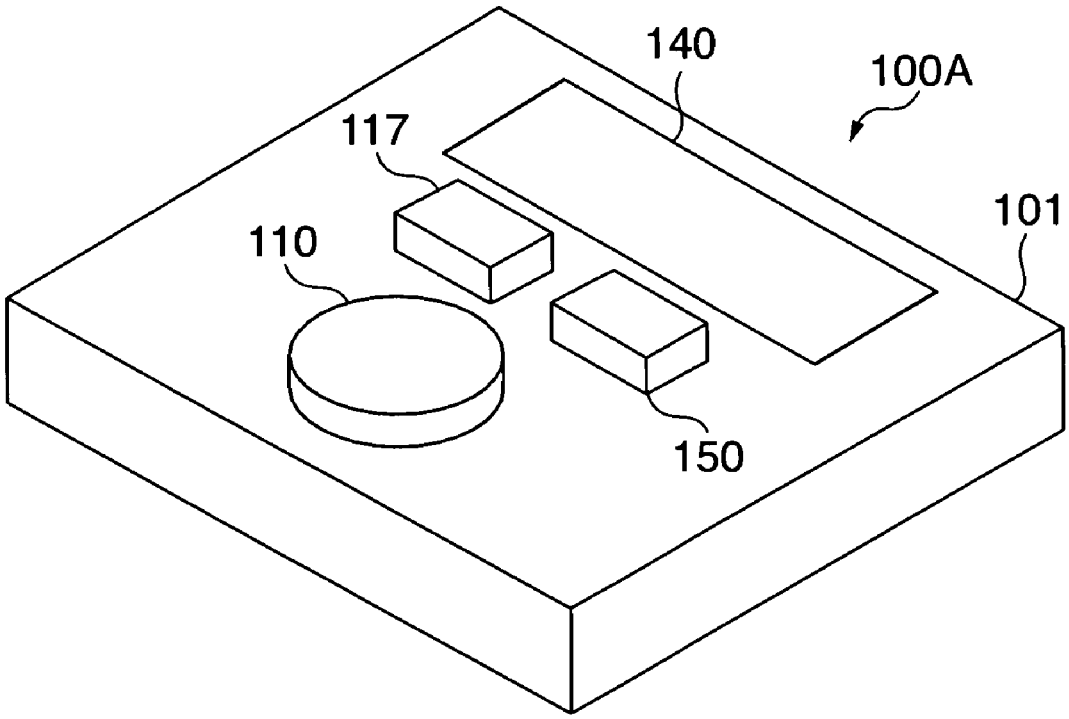
FIG. 6 is an external view of a light-emission responder according to a third embodiment of this invention.
Figure 7:
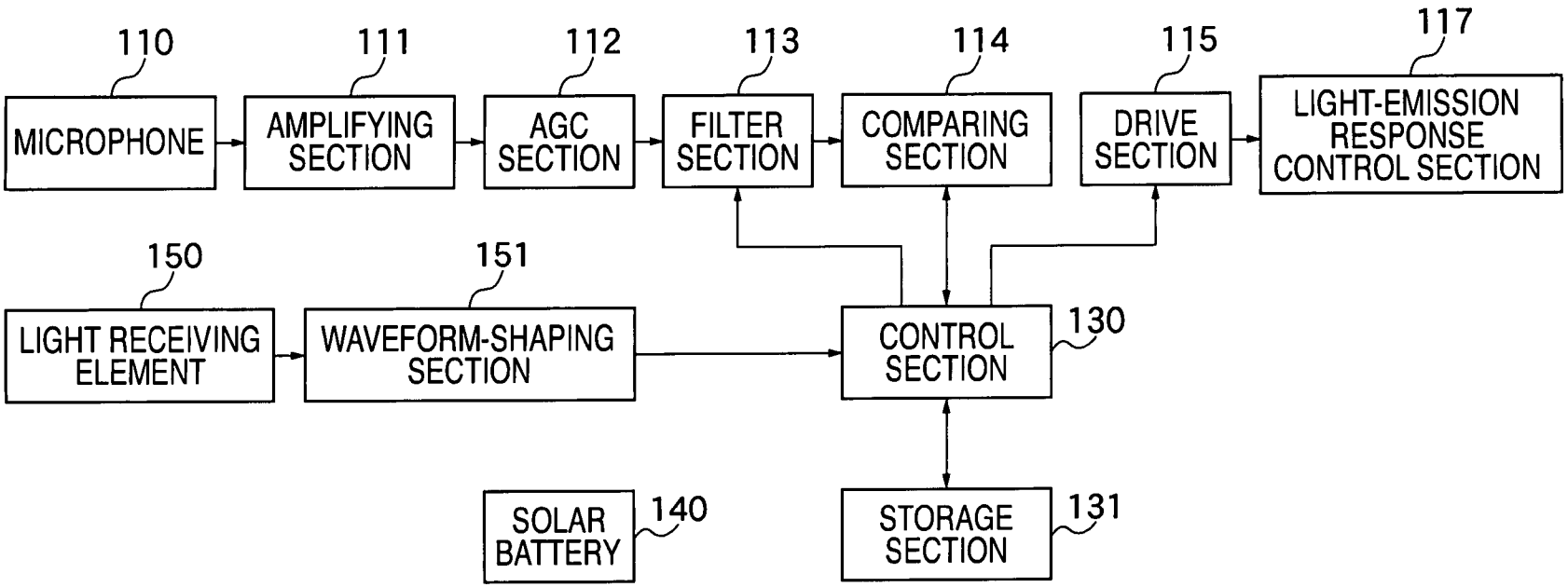
FIG. 7 is a block diagram showing the hardware structure of the light-emission responder in FIG. 6.

FIG. 6 shows in external view the light-emission responder 100A of the third embodiment of this invention, and FIG. 7 shows in block diagram the hardware structure of the light-emission responder 100A in FIG. 6.

As shown in FIG. 6, the light-emission responder 100A includes the housing 101 having a surface thereof on which the solar battery 140, the light-emission response control section 117, the microphone 110, and a light receiving element 150 are disposed. The light receiving element 150 is, for example, a photodiode and adapted to output an electrical signal corresponding to received light. The electrical signal output from the light receiving element 150 is input to a waveform-shaping section 151. The waveform-shaping section 151 shapes the waveform of the electrical signal output from the light receiving element 150, and outputs the waveform-shaped electrical signal to the control section 130.

Figure 8:
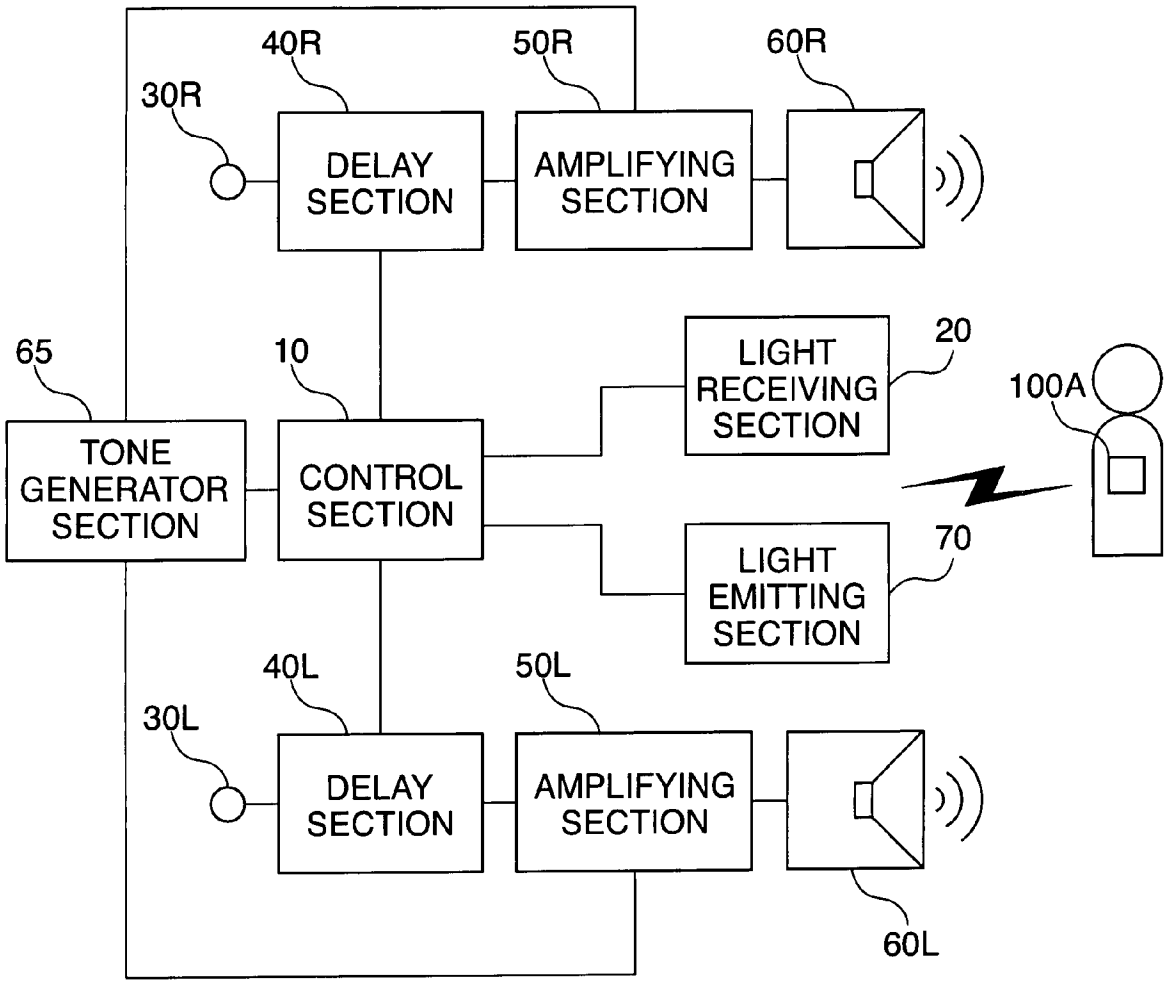
FIG. 8 is a view of the whole construction of a system in which the light-emission responder in FIG. 6 is utilized.

FIG. 8 shows an example of the whole construction of a system that utilizes the light-emission responder 100A in FIG. 6. In FIG. 8, parts which are the same as those shown in FIG. 4 are denoted by the same numerals as in FIG. 4 and explanations thereof will be omitted.

The light emitting section 70 includes a light emitting element, and under the control of the control section 10, outputs light having a predetermined frequency. The light emitting element of the light emitting section 70 spreads in all the directions centering around the light emitting element to reach broad areas. In this system, the light-emission responder 100A is attached to the clothes of the listener.

Figure 9:
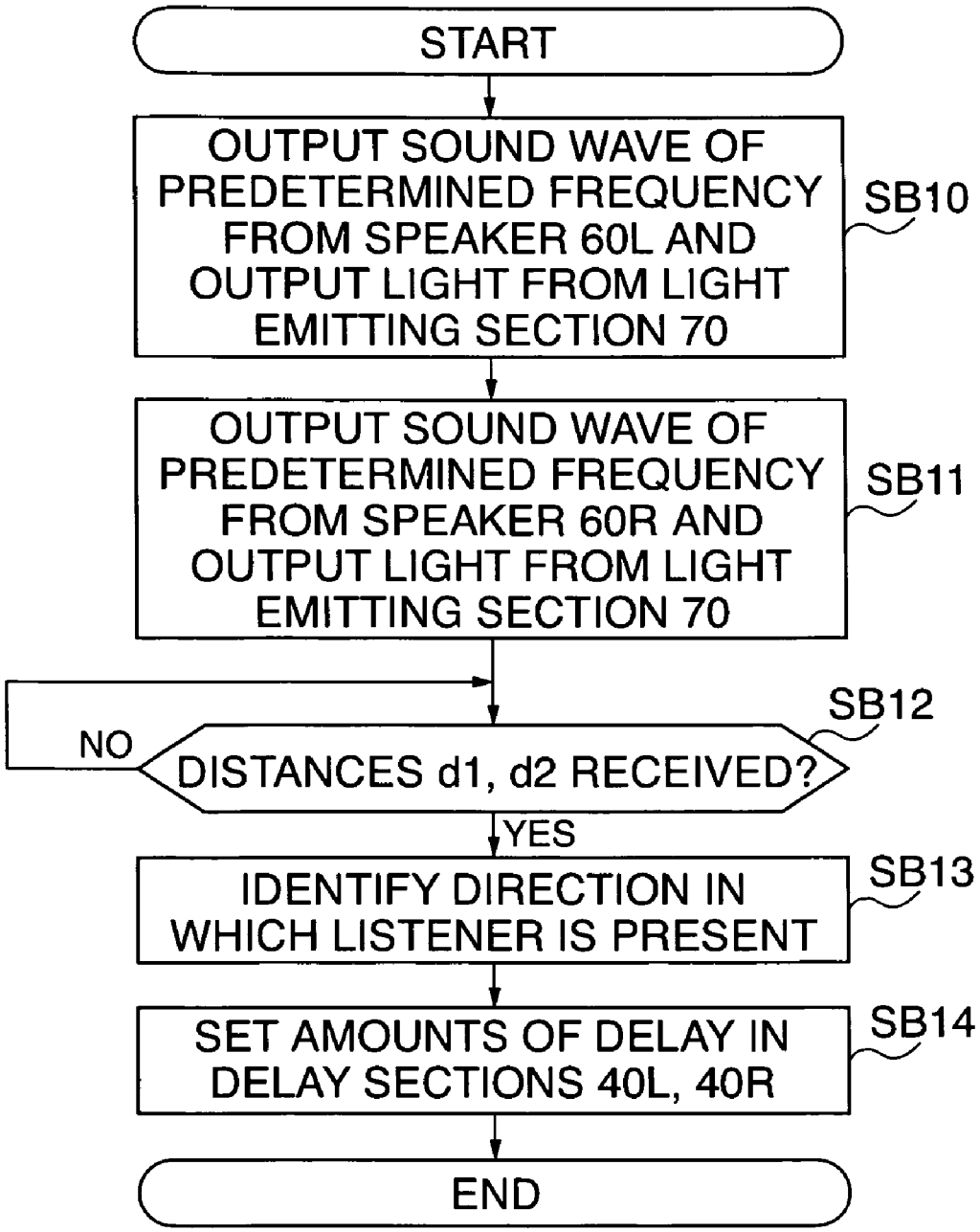
FIG. 9 is a flowchart of processing implemented by a control section of the system in FIG. 8.
Figure 10:
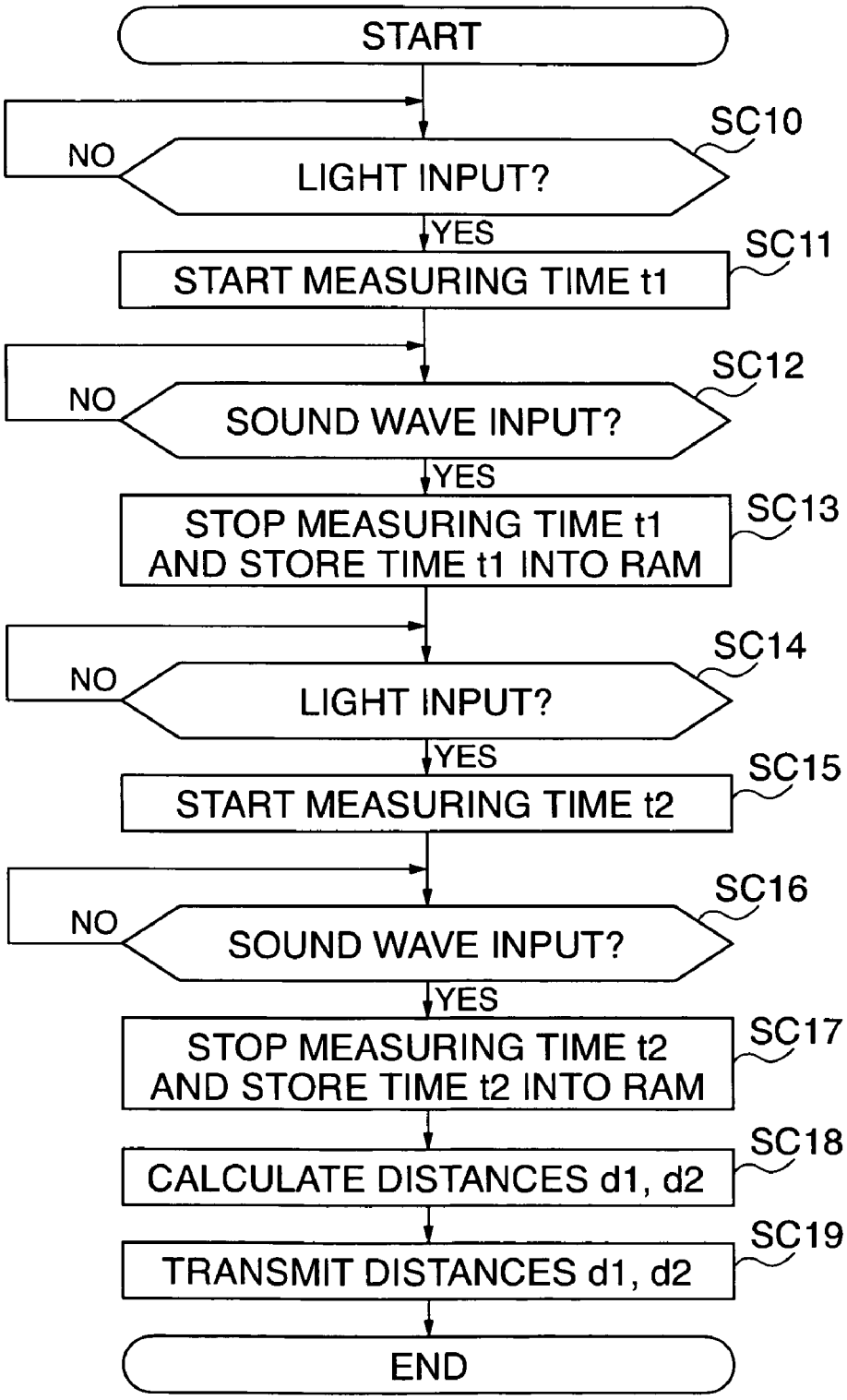
FIG. 10 is a flowchart of processing implemented by a control section of the light-emission responder in FIG. 6.

Next, operations of the system shown in FIG. 8 will be explained with reference to FIGS. 9 and 10. FIG. 9 shows in flowchart processing implemented by the control section 10 of the system in FIG. 8. FIG. 10 shows in flowchart processing implemented by the control section 130 of the light-emission responder 100A in FIG. 6. In the following, a description will be given of the operations in a case where the distance d0 between the speakers 60L, 60R is stored in the nonvolatile memory of the control section 10.

Referring to FIG. 9, the control section 10 first controls the light emitting section 70 to output light of a predetermined frequency, and controls the tone generator section 65 to output an audio signal belonging to the frequency range f1 to the amplifying section 50L, thereby causing a sound wave belonging to the frequency range f1 to be output from the speaker 60L (step SB10).

The light output from the light emitting section 70 reaches the light-emission responder 100A worn by the listener. When the light output from the light emitting section 70 reaches the light-emission responder 100A, the reached light is converted into an electrical signal by the light receiving element 150. The electrical signal is waveform-shaped by the waveform-shaping section 151 and then output to the control section 130. As shown in FIG. 10, when the waveform-shaped electrical signal is input (YES to step SC10), the control section 130 starts measuring the time t1 (step SC11).

On the other hand, the sound wave output from the speaker 60L reaches the light-emission responder 100A worn by the listener later than the light output from the light emitting section 70. The reached sound wave is converted into an electrical signal by the microphone 110. The electrical signal generated by the microphone 110 is amplified by the amplifying section 111 and then output to the AGC section 112. In the AGC section 112, the input electrical signal is subjected to an amplitude adjustment such that the peak of the amplitude becomes constant. The amplitude-adjusted electrical signal is output to the filter section 113. When supplied with the electrical signal, the filter section 113 outputs, to the comparing section 114, an electrical signal belonging to a frequency range which is the same as the frequency range f1.

In the comparing section 114, the electrical signal output from the filter section 113 is compared with the reference voltage notified in advance from the control section 130, and it is determined whether the voltage of the electrical signal is higher or lower than the reference voltage. When the electrical signal is output from the filter section 113 and as a result the level of the electrical signal is raised higher than the reference voltage, an "H" signal is output from the comparing section 114 to the control section 130. When supplied with the "H" signal (YES to step SC12), the control section 130 stops measuring the time t1, and stores the measured time t1 (step SC13).

Next, as shown in FIG. 9, the control section 10 controls the light emitting section 70 to output light of a predetermined frequency, and controls the tone generator section 65 to output an audio signal belonging to the frequency range f1 to the amplifying section 50R, thereby causing the speaker 60R to output a sound wave of the frequency range f1 (step SB11).

When the light output from the light emitting section 70 reaches the light-emission responder 100A, the reached light is converted into an electrical signal by the light receiving element 150 and the electrical signal is output. The electrical signal output from the light receiving element 150 is waveform-shaped by the waveform-shaping section 151 and then output to the control section 130. As shown in FIG. 10, when supplied with the waveform-shaped electrical signal (YES to step SC14), the control section 130 starts measuring the time t2 (step SC15).

On the other hand, the sound wave output from the speaker 60R reaches the light-emission responder 100A worn by the listener later than the light output from the light emitting section 70. When the sound wave output from the speaker 60R reaches the light-emission responder 100A, an "H" signal is input to the control section 130 as in the case where the sound wave output from the speaker 60L reaches the light-emission responder 100A. When supplied with the "H" signal (YES to step SC16), the control section 130 stops measuring the time t2 and stores the measured time t2 (step SC17).

Next, the control section 130 multiplies the time t1, i.e., the time required for the sound wave output from the speaker 60L to reach the light-emission responder 100A, by the sound velocity to determine the distance d1 from the speaker 60L to the light-emission responder 100A. Also, the control section 10 multiplies the time t2, i.e., the time required for the sound wave output from the speaker 60R to reach the light-emission responder 100A, by the sound velocity to determine the distance d2 from the speaker 60R to the light-emission responder 100A (step SC18). Next, the control section 130 controls the drive section 115 to cause the light-emitting element 120 to output an optical signal, thereby transmitting by way of the optical signal the distances d1, d2 to the light receiving section 20 (step SC19).

Referring to FIG. 9, when the optical signal is received by the light receiving section 20, the optical signal is converted into an electrical signal, which is input to the control section 10. When supplied with the electrical signal representing the distances d1, d2 (YES to step SB12), the control section 10 determines an angle formed between the side connecting the speakers 60L, 60R and the side connecting the speaker 60R and the light-emission responder 100A based on the distances d1, d2 represented by the electrical signal and the stored distance d0 between the speakers 60L, 60R. When the angle is determined, the control section 10 identifies the direction of the light-emission responder 100A as viewed from the speakers 60L, 60R, i.e., the direction in which the listener is present (step SB13).

When the direction in which the listener is present is determined, the control section 10 controls the delay sections 40L, 40R to generate a time difference between the audio signals respectively input to the input terminals 30L, 30R such that the directivity direction of the sound wave output from the speaker system is made coincident with the direction of the listener (step SB14). When amounts of delay for the delay sections 40L, 40R are set, the directivity direction of the sound wave output from the speaker system is made coincident with the direction of the light-emission responder 100A, i.e., the direction of the listener. The speaker system always detects the position of the listener and controls the directivity direction of the sound output from the speaker system in accordance with the detected position by performing the above described processing at a predetermined cycle.

As described above, this system can also detect the position of the listener without requiring the listener to perform a laborious operation, and the listener can obtain the optimum acoustic field without the need of adjusting the positions of the speakers 60L, 60R. In addition, even if the listener moves during the audio signal reproduction, the directivity direction of the sound output from the speaker system is changed to provide the listener with the optimum acoustic field. It should be noted that in this system, the distance d1 may be calculated and transmitted to the control section 10 upon completion of the measurement of time t1, and the distance d2 may be calculated and transmitted to the control section 10 upon completion of the measurement of time t2.

In this embodiment, the light-emission responder 100A may include a light-emission response output section 116 and the distances d1, d2 may be transmitted by way of a radio wave. A radio wave receiving section for receiving the radio wave may be connected to the control section 10 for receiving the distances d1, d2 transmitted by way of radio wave from the light-emission responder 100A.

Next, a light-emission responder according to a fourth embodiment of this invention will be explained. This embodiment differs from the second embodiment in that the direction of the light-emission responder is determined based on light and sound output from the light-emission responder.

Figure 11:
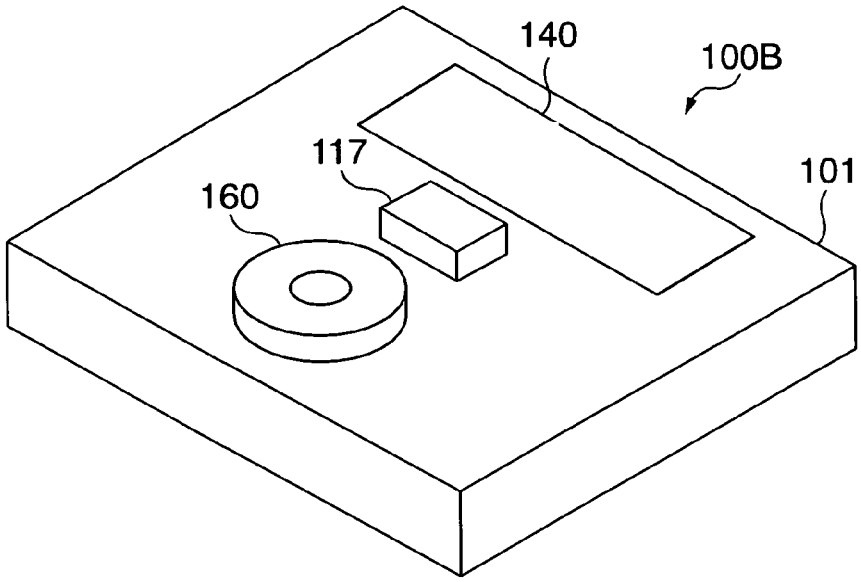
FIG. 11 is an external view of a light-emission responder according to a fourth embodiment of this invention.
Figure 12:
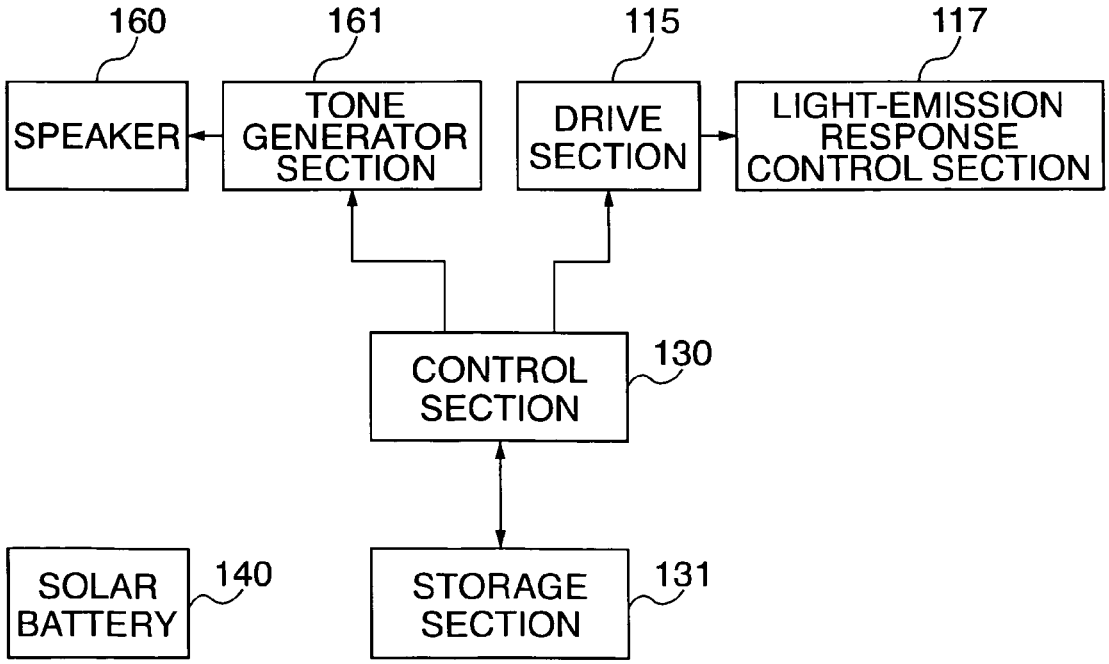
FIG. 12 is a block diagram showing the hardware structure of the light-emission responder in FIG. 11.

FIG. 11 shows in external view the light-emission responder 100B of the fourth embodiment of this invention. FIG. 12 shows in block diagram the hardware structure of the light-emission responder 100B in FIG. 11. In FIGS. 11 and 12, parts which are the same as those shown in FIG. 4 are denoted by the same reference numerals as in FIG. 4 and explanations thereof will be omitted.

As shown in FIG. 11, the light-emission responder 100B includes a housing having a surface thereof on which the solar battery 140, the light-emission response control section 117, and a speaker 160 are disposed. Under the control of the control section 130, a tone generator section 161 outputs an audio signal belonging to the frequency range f1 to the speaker 160. When supplied with the audio signal belonging to the frequency range f1, the speaker 160 outputs a sound wave corresponding to the audio signal. To be noted, the speaker 160 has a wide directivity.

Figure 13:
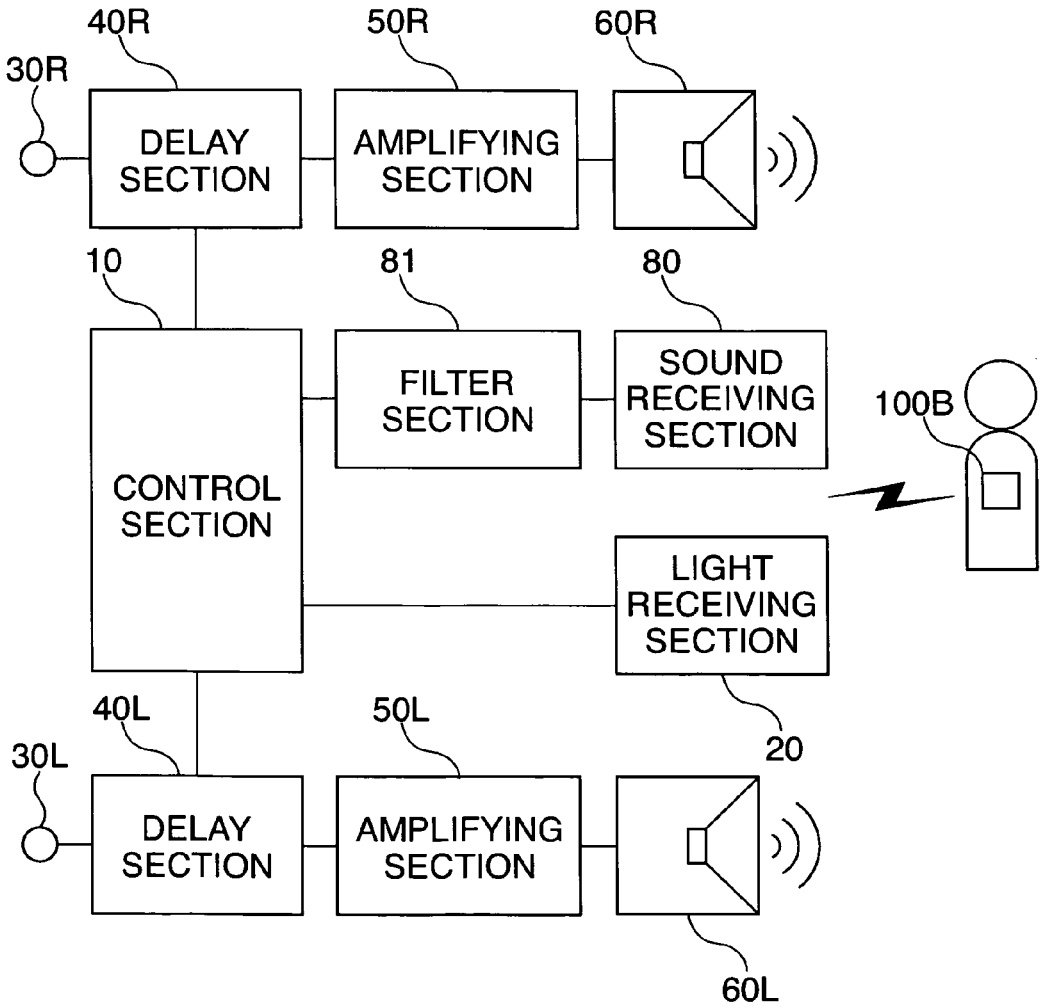
FIG. 13 is a view showing an example of the whole construction of a system in which the light-emission responder in FIG. 11 is utilized.

FIG. 13 shows an example of the whole construction of a system in which the light-emission responder 100B of FIG. 11 is utilized. In FIG. 13, parts which are the same or similar to those shown in FIG. 4 are denoted by the same reference numerals as in FIG. 4 and explanations thereof will be omitted.

A sound receiving section 80 includes two microphones, and is adapted to convert an input sound wave into an electrical signal and output the electrical signal to a filter section 81. The filter section 81 includes for example a band pass filter, and is adapted to output, to the control section 10, an electrical signal belonging to a particular frequency range out of the electrical signal output from the sound receiving section 80. In this system, the light-emission responder 100*b* is attached to the clothes of the listener.

Next, a description will be given of operation of the system in FIG. 13. In the following, the operation is described for a case where the distance between the two microphones of the sound receiving section 80 is stored in the nonvolatile memory of the control section 10.

First, the control section 130 of the light-emission responder 100B controls the drive section 115 to cause the light-emission response control section 117 to output light of a predetermined frequency, and controls a tone generator section 161 to output an audio signal belonging to the frequency range f1 to the speaker 160. Since the speaker 160 has a broad directivity, a sound wave output from the speaker 160 reaches broad areas centering around the speaker 160.

The light output from the light-emission response control section 117 is propagated through air and reaches the light receiving section 20. When the light output from the light-emission response control section 117 reaches the light receiving section 20, the reached light is converted into an electrical signal by the light receiving section 20. When the electrical signal is input to the control section 10, the control section 10 carries out processing to identify the position of the light-emission responder 100B.

Figure 14:
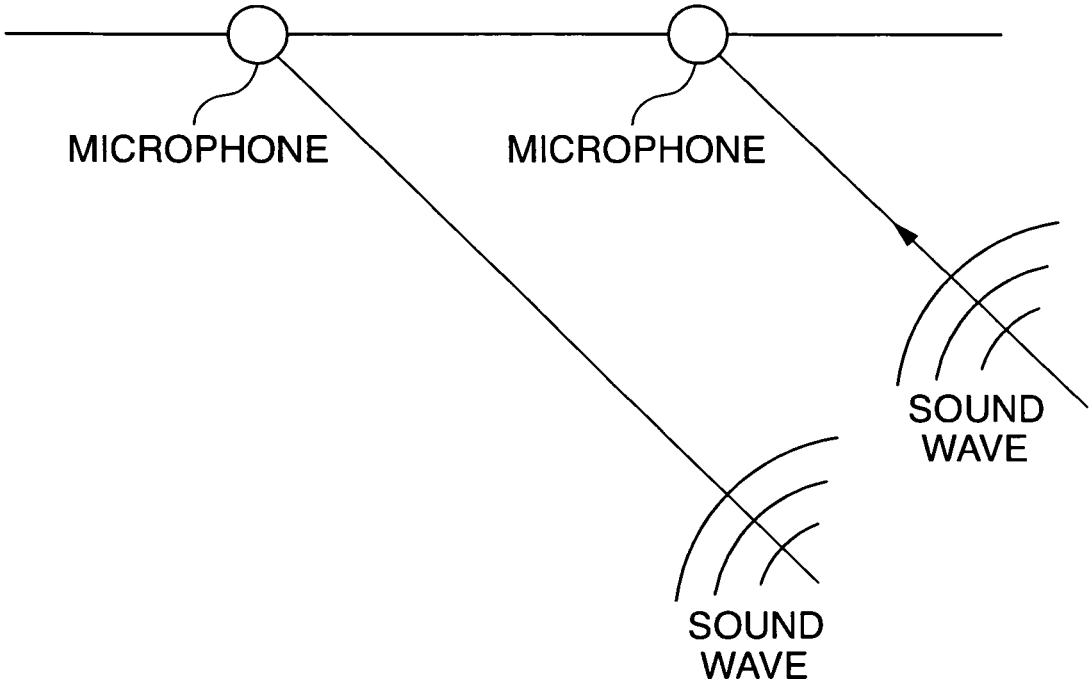
FIG. 14 is a view showing by way of example how a sound wave reaches a sound receiving section of the system in FIG. 13.

The sound wave output from the speaker 160 is propagated through air and reaches the sound receiving section 80 later than the light output from the light-emission response control section 117. In the sound receiving section 80, two microphones provided therein each output an electrical signal corresponding to the sound wave. These microphones are disposed as shown by way of example in FIG. 14. When the sound wave is input to the microphones from an oblique direction, a time difference is generated between the electrical signals output from the microphones since there is a difference between distances from the speaker 160 to the microphones. When supplied with the electrical signals from the microphones, the control section 10 determines the time difference between the electrical signals, and identifies the direction of the light-emission responder 100B based on the time difference between the electrical signals, as described in Japanese Laid-open Patent Publication No. 9-238390.

When the direction in which the listener is present is determined, the control section 10 controls the delay sections 40L, 40R to generate a time difference between audio signals respectively input to the input terminals 30L, 30R such as to make the directivity direction of a sound wave output from the speaker system coincident with the direction of the listener. When amounts of delay for the delay sections 40L, 40R are set, the directivity direction of the sound wave output from the speaker system is made coincident with the direction of the light-emission responder 100B, i.e., the direction of the listener. The speaker system always detects the position of the listener and controls the directivity direction of the sound output from the speaker system in accordance with the detected position by performing the above described processing at a predetermined cycle.

As described above, the present system can also detect the position of the listener without requiring the listener to carry out a laborious operation, and the listener can obtain the optimum acoustic field without adjusting the positions of the speakers 60L, 60R. Even if the listener moves during the audio signal reproduction, the directivity direction of the sound output from the speaker system is changed such as to permit the listener to obtain the optimum acoustic field.

Next, a light-emission responder according to a fifth embodiment of this invention will be explained with reference to FIG. 15. This embodiment differs from the second embodiment in that there are a plurality of light-emission responders and a speaker array is employed.

Figure 15:
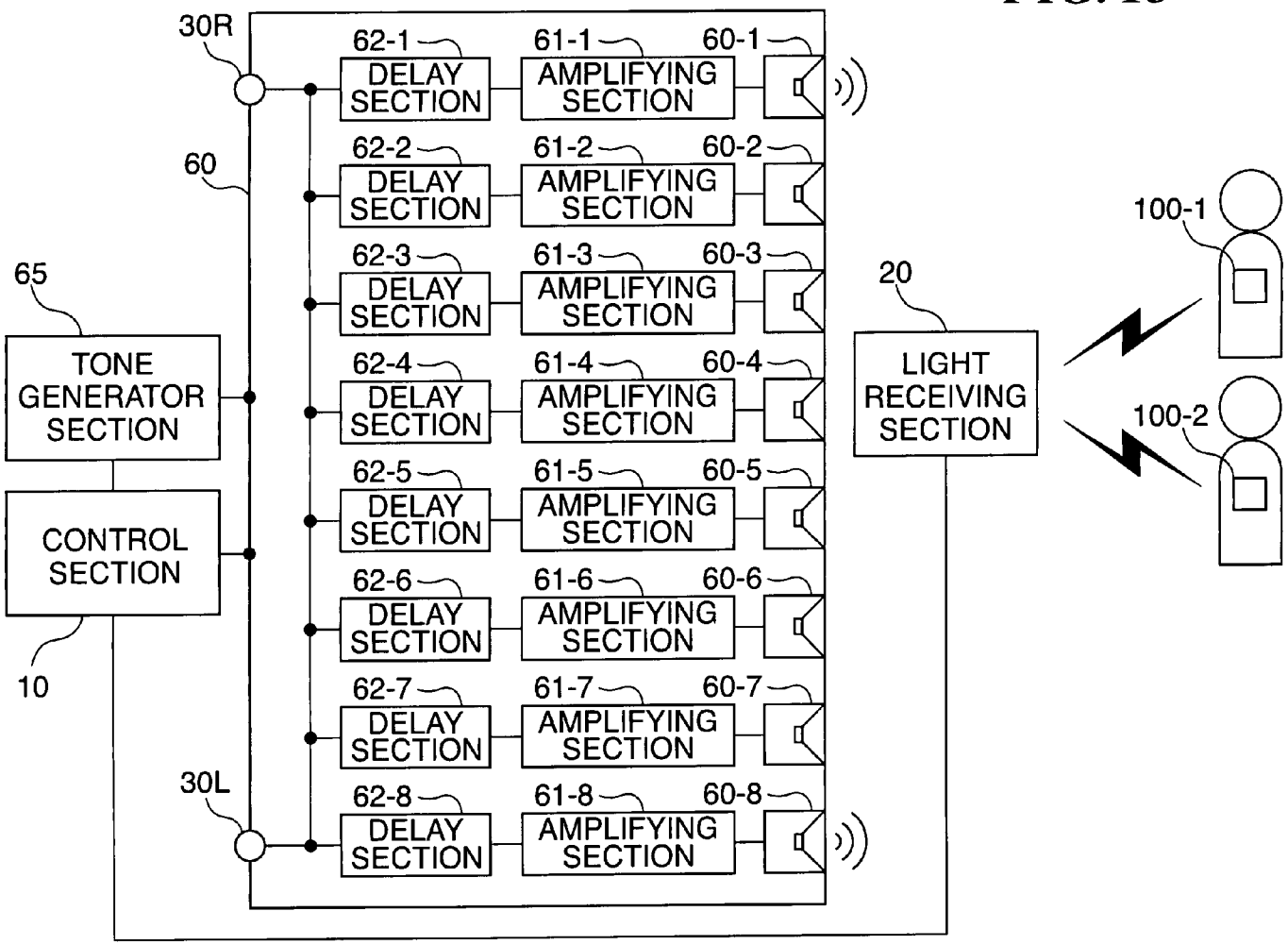
FIG. 15 is a view showing an example of the whole construction of a system in which light-emission responders according to a fifth embodiment of this invention are utilized.

FIG. 15 shows an example of the whole construction of the light-emission responder of the fifth embodiment of this invention. In FIG. 15, parts which are the same as those of FIG. 4 are denoted by the same reference numerals as in FIG. 4 and explanations thereof will be omitted.

As shown in FIG. 15, a speaker array 60 is comprised of a plurality of speaker units 60-1 to 60-8, which are disposed in line. In the speaker array 60, delay sections 62-1 to 62-8 that delay audio signals input thereto and amplifying sections 61-1 to 61-8 that amplify audio signals output from the delay sections 62-1 to 62-8 and supply the amplified audio signals to the speaker units are provided such as to correspond to the speaker units. In FIG. 15, the speaker units are eight in number, however, the number of the speaker units is not limited to eight.

The input terminal 30L is supplied with a left-channel audio signal, and the input terminal 30R is supplied with a right-channel audio signal. The audio signal input to the input terminal 30R is supplied to the delay sections 62-1 to 62-8, and the audio signal input to the input terminal 30L is supplied to the delay sections 62-1 to 62-8. Under the control of the control section 10, the tone generator section 65 outputs an audio signal of a particular frequency to the speaker array 60.

The control section 10 is connected to the tone generator section 65 and the speaker array 60. The control section 10 controls the tone generator section 65 to output the audio signal to the speaker array 60. The control section 10 controls the delay sections of the speaker array 60 to delay the audio signals input to the speaker units.

The light-emission responders 100-1, 100-2 are respectively attached to clothes of listeners. The light-emission responders 100-1; 100-2 are the same in construction as the light-emission responder 100 of the second embodiment. In the light-emission responders 100-1, 100-2, there are stored identifiers ID1, ID2 to uniquely identify respective ones of the light-emission responders.

Figure 16:
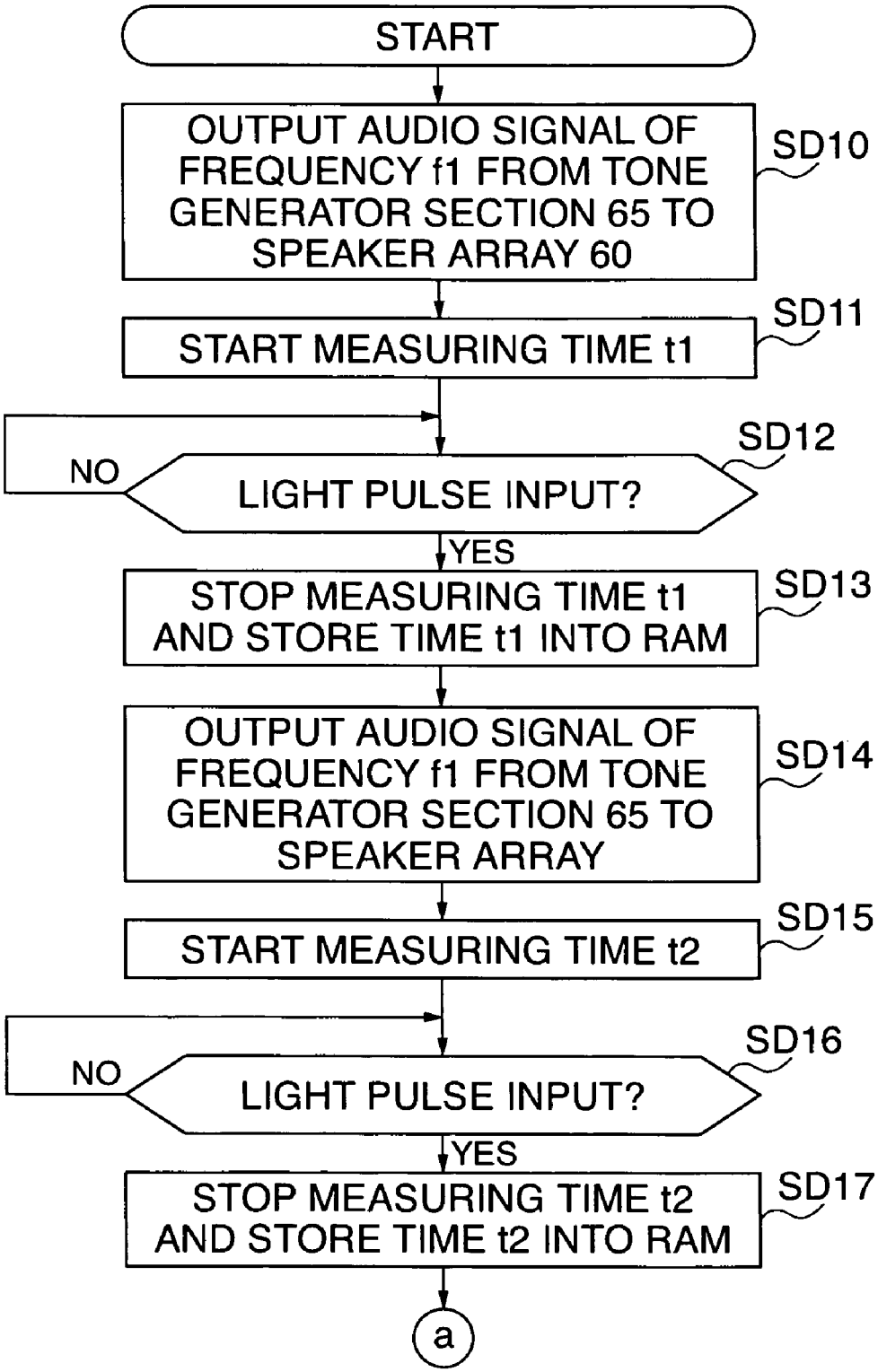
FIG. 16 is a flowchart of processing implemented by a control section of the system shown in FIG. 15.
Figure 17:
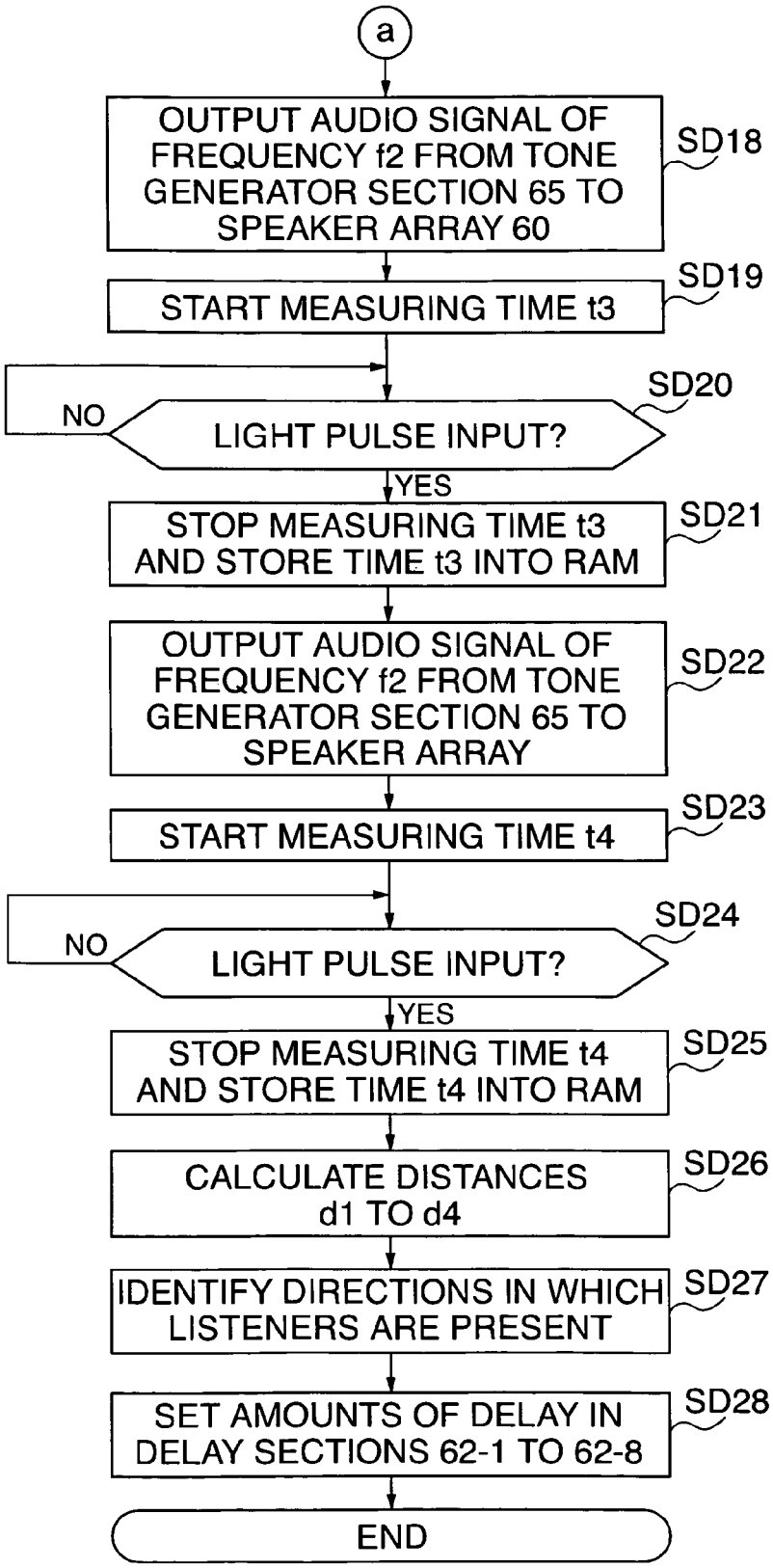
FIG. 17 is a flowchart of processing implemented by the control section of the system in FIG. 15.

Next, an explanation will be given of operation of the light-emission responder in FIG. 15 with reference to FIGS. 16 and 17. FIGS. 16 and 17 are a flowchart of processing implemented by the control section 10 of the light-emission responder in FIG. 15. In the following, an explanation of operation is given for a case where the distance d0 between the speaker units 60-1, 60-8 is stored in the nonvolatile memory of the control section 10, the filter section 113 of the light-emission responder 100-1 permits a signal having a frequency f1 to pass therethrough, and the filter section 113 of the light-emission responder 100-2 permits a signal having a frequency f2 different from the frequency f1 to pass therethrough.

Referring to FIG. 16, the control section 10 first controls the tone generator section 65 to output the audio signal of frequency f1 to the speaker array 60 (step SD10). The control section 10 starts measuring the time t1 elapsed from when the audio signal is output to the speaker array 60 (step SD11). The control section 10 controls the speaker array 60 such that audio signal output from the tone generator section 65 is supplied to the amplifying section 61-1. When the audio signal of frequency f1 is supplied to the amplifying section 61-1, a sound wave of frequency f1 is output from the speaker unit 60-1.

When the sound wave output from the speaker unit 60-1 reaches the light-emission responder 100-1, the sound wave is converted by the microphone 110 into an electrical signal. The electrical signal is amplified by the amplifying section 111 and output to the AGC section 112. In the AGC section 112, the supplied electrical signal is subjected to an amplitude adjustment such that the peak of the amplitude is made constant. The amplitude-adjusted electrical signal is output to the filter section 113. The electrical signal of frequency f1 is output from the filter section 113 to the comparing section 114.

When the electrical signal of frequency f1 is output from the filter section 113, an "H" signal is output from the comparing section 114 as in the case of the second embodiment, and a light pulse notifying that the sound wave of frequency f1 is input is output from the light-emission response control section 117. The sound wave output from the speaker unit 60-1 also reaches the light-emission responder 100-2, however, a light pulse is not output from the light-emission responder 100-2 since the filter section 113 of the responder 100-2 does not permit the electrical signal of frequency f1 to pass therethrough.

When the light pulse output from the light-emission responder 100-1 reaches the light receiving section 20, the light reaching the light receiving section 20 is converted into an electrical signal, which is then output to the control section 10. When the electrical signal output from the light receiving section 20 is input to the control section 10 (YES to step SD12), the control section 10 stops measuring the time t1, and stores the measured time t1 into the RAM (step SD13).

Next, the control section 10 controls the tone generator section 65 to output an audio signal of frequency f1 to the speaker array 60 (step SD14). The control section 10 starts measuring the time t2 elapsed from when the audio signal is output to the speaker array 60 (step SD15). The control section 10 controls the speaker array 60 such that the audio signal output from the tone generator section 65 is supplied to the amplifying section 61-8. When the audio signal of frequency f1 is supplied to the amplifying section 61-8, a sound wave of frequency f1 is output from the speaker unit 60-8.

When the sound wave output from the speaker unit 60-8 reaches the light-emission responder 100-1, the light-emission responder 100-1 outputs a light pulse notifying that the sound wave of frequency f1 is input, as in the case when the sound wave output from the speaker unit 60-1 reaches the light-emission responder 100-1. When the light pulse reaches the light receiving section 20, the light reaching the light receiving section 20 is converted into an electrical signal, which is output to the control section 10. When the electrical signal output from the light receiving section 20 is supplied to the control section 10 (YES to step SD16), the control section 10 stops measuring the time t2, and stores the measured time t2 into the RAM (step SD17).

Next, as shown in FIG. 17, the control section 10 controls the tone generator section 65 to output an audio signal of frequency f2 to the speaker array 60 (step SD18). The control section 10 starts measuring a time t3 elapsed from when the audio signal is output to the speaker array 60 (step SD19). The control section 10 controls the speaker array 60 such that the audio signal output from the tone generator section 65 is supplied to the amplifying section 61-1. When the audio signal of frequency f2 is supplied to the amplifying section 61-1, a sound wave of frequency f2 is output from the speaker unit 60-1.

When the sound wave output from the speaker unit 60-1 reaches the light-emission responder 100-2, the light-emission responder 100-2 outputs a light pulse notifying that the sound wave of frequency f2 is input, as in the case when the sound wave output from the speaker unit 60-1 reaches the light-emission responder 100-1. When the light pulse reaches the light receiving section 20, the light reaching the light receiving section 20 is converted into an electrical signal, which is output to the control section 10. When the electrical signal output from the light receiving section 20 is supplied to the control section 10 (YES to step SD20), the control section 10 stops measuring the time t3, and stores the measured time t3 into the RAM (step SD21). The sound wave output from the speaker unit 60-1 also reaches the light-emission responder 100-1. However, the filter section 113 of the light-emission responder 100-1 does not permit the electrical signal of frequency f2 to pass therethrough, and a light pulse is not output from the light-emission responder 100-1.

Next, the control section 10 controls the tone generator section 65 to output the audio signal of frequency f2 to the speaker array 60 (step SD22). The control section 10 starts measuring a time t4 elapsed from when the audio signal is output to the speaker array 60 (step SD23). The control section 10 controls the speaker array 60 such that the audio signal output from the tone generator section 65 is supplied to the amplifying section 61-8. When the audio signal of frequency f2 is supplied to the amplifying section 61-8, a sound wave of frequency f2 is output from the speaker unit 60-8.

When the sound wave output from the speaker unit 60-8 reaches the light-emission responder 100-2, the light-emission responder 100-2 outputs a light pulse notifying that the sound wave of frequency f2 is input, as in the case when the sound wave output from the speaker unit 60-1 reaches. When the light pulse reaches the light receiving section 20, the light reaching the light receiving section 20 is converted into an electrical signal, which is output to the control section 10. When the electrical signal output from the light receiving section 20 is supplied to the control section 10 (YES to step SD24), the control section 10 stops measuring the time t4 and stores the measured time t4 into the RAM (step SD25).

Next, the control section 10 multiplies the time t1, i.e., the time required for the sound wave output from the speaker unit 60-1 to reach the light-emission responder 100-1, by the sound velocity to determine a distance d1 from the speaker unit 60-1 to the light-emission responder 100-1. The control section 10 multiplies the time t2, i.e., the time required for the sound wave output from the speaker unit 60-8 to reach the light-emission responder 100-1, by the sound velocity to determine a distance d2 from the speaker unit 60-8 to the light-emission responder 100-1.

Furthermore, the control section 10 multiplies the time t3, i.e., the time required for the sound wave output from the speaker unit 60-1 to reach the light-emission responder 100-2, by the sound velocity to determine a distance d3 from the speaker unit 60-1 to the light-emission responder 100-2. The control section 10 multiplies the time t4, i.e., the time required for the sound wave output from the speaker unit 60-8 to reach the light-emission responder 100-2, by the sound velocity to determine a distance d4 from the speaker unit 60-8 to the light-emission responder 100-2 (step SD26).

Based on the distances d1, d2 and the stored distance d0 between the speaker units 60-1, 60-8, the control section 10 determines an angle formed between the side connecting the speaker units 60-1 and 60-8 and the side connecting the speaker unit 60-1 and the light-emission responder 100-1. Based on the distances d0 to d2, the control section 10 determines an angle formed between the side connecting the speaker units 60-1, 60-8 and the side connecting the speaker unit 60-8 and the light-emission responder 100-1. When these angles are determined, the control section 10 identifies the direction of the light-emission responder 100-1 as seen from the speaker units 60-1, 60-8. As in the case of the determination for the light-emission responder 100-1, the direction of the light-emission responder 100-2 as seen from the speaker units 60-1, 60-8 is determined based on the distances d0, d3, and d4 (step SD27).

The speaker array controls audio signals to be supplied to the speaker units, whereby acoustic beams can be output in different directions. When the direction of the light-emission responder 100-1 and the distances are identified, the control section 10 controls the delay sections 62-1 to 62-8 such that a first acoustic beam output from the speaker system has a directivity direction coincident with the direction of the light-emission responder 100-1 and the distances. When the direction of the light-emission responder 100-2 is identified, the control section 10 controls the delay sections 62-1 to 62-8 such that a second acoustic beam output from the speaker system has a directivity direction coincident with the direction of the light-emission responder 100-2 (step SD28).

As described above, according to the present system, even if plural listeners are present in the acoustic field, the positions of the listeners can be detected without requiring the listeners to carry out a laborious operation, and sound waves are output from the speaker array 60 toward the listeners. Therefore, the listeners can obtain the optimum acoustic field.

In this embodiment, each of the light-emission responders 100-1, 100-2 may include the light-emission response output section 116. When sound waves from the speakers 60R, 60L are input into the light-emission responders 100, radio waves may be output from the light-emission response output sections 116, with light emitting elements simply to be lighted. A radio wave receiving section for receiving a radio wave may also be connected to the control section 10, radio waves output from the light-emission responders 100 may be received, and time periods each elapsed from when sound wave is output to when radio wave is received may be measured, whereby the positions of the listeners can be identified.

Next, a system utilizing light-emission responders according to a sixth embodiment of this invention will be described. This embodiment is different from the second embodiment in that there are a plurality of light-emission responders and the position where a sound image is to be localized is controlled.

Figure 18:
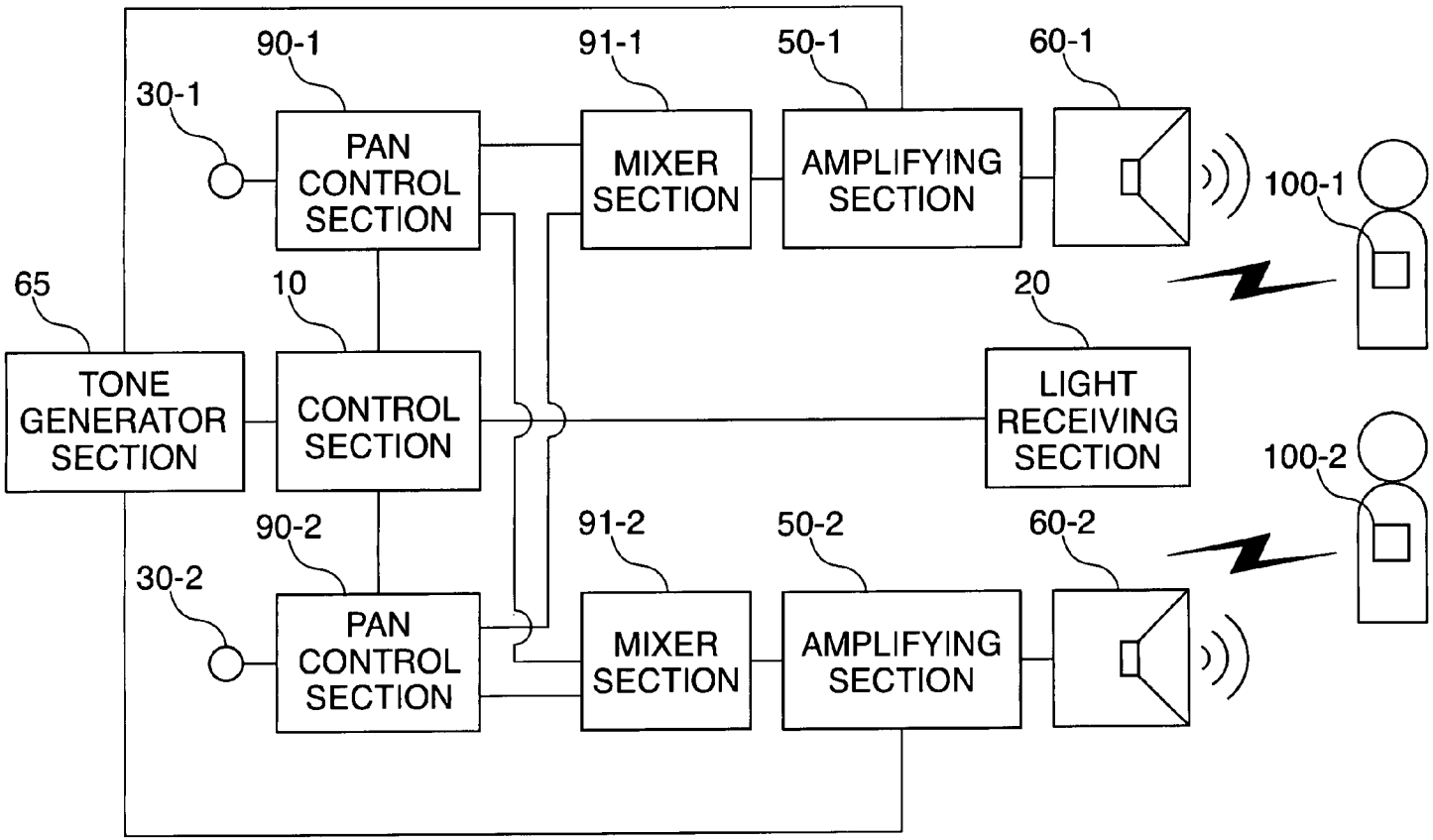
FIG. 18 is a view showing an example of the whole construction of a system in which light-emission responders according to a sixth embodiment of this invention are utilized.

FIG. 18 shows an example of the whole construction of a system in which the light-emission responders of the sixth embodiment of this invention are utilized.

Referring to FIG. 18, an input terminal 30-1 is adapted to receive a first channel audio signal (for example, a Japanese audio channel of a bilingual broadcast), and an input terminal 30-2 is adapted to receive a second channel audio signal (for example, a foreign language audio channel of the bilingual broadcast). The audio signal input to the input terminal 30-1 is supplied to a pan control section 90-1, and the audio signal input to the input terminal 30-2 is supplied to a pan control section 90-2. The pan control sections 90-1, 90-2 are each for setting the lateral sound image localization of the input audio signal. Under the control of the control section, each of the pan control sections outputs the input audio signal to mixer sections 91-1, 91-2. The mixer sections 91-1, 91-2 are each for mixing audio signals supplied thereto. The mixer section 91-1 supplies the mixed audio signal to the amplifying section 50-1, and the mixer section 91-2 supplies the mixed audio signal to the amplifying section 50-2. Each of the amplifying sections 50-1, 50-2 amplifies the input audio signal and outputs the amplified audio signal to the speaker connected to the amplifier. The speaker 60-1 is connected to the amplifying section 50-1, and the speaker 60-2 is connected to the amplifying section 50-2. Each of the speakers converts the audio signal output from the amplifier connected thereto into a sound wave and outputs the sound wave.

Each of the light-emission responders 100-1, 100-2 is attached to the clothes of a listener. The light-emission responders 100-1, 100-2 are the same in construction as the light-emission responder of the second embodiment. The light-emission responder 100-1 stores an identifier ID1 to uniquely identify the light-emission responder, and the light-emission responder 100-2 stores an identifier ID2 to uniquely identify the same.

Figure 19:
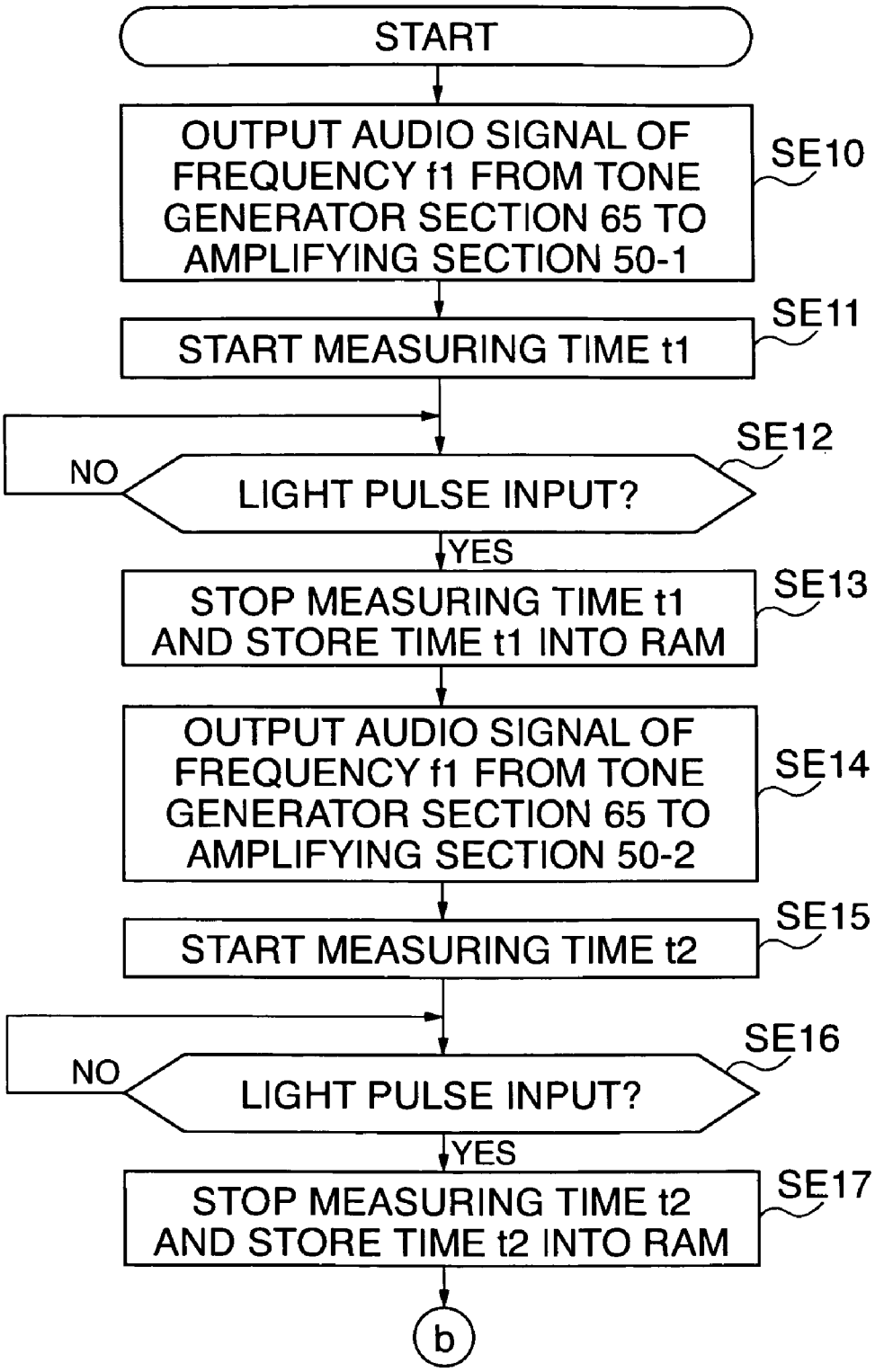
FIG. 19 is a flowchart of processing implemented by a control section of the system shown in FIG. 18.
Figure 20:
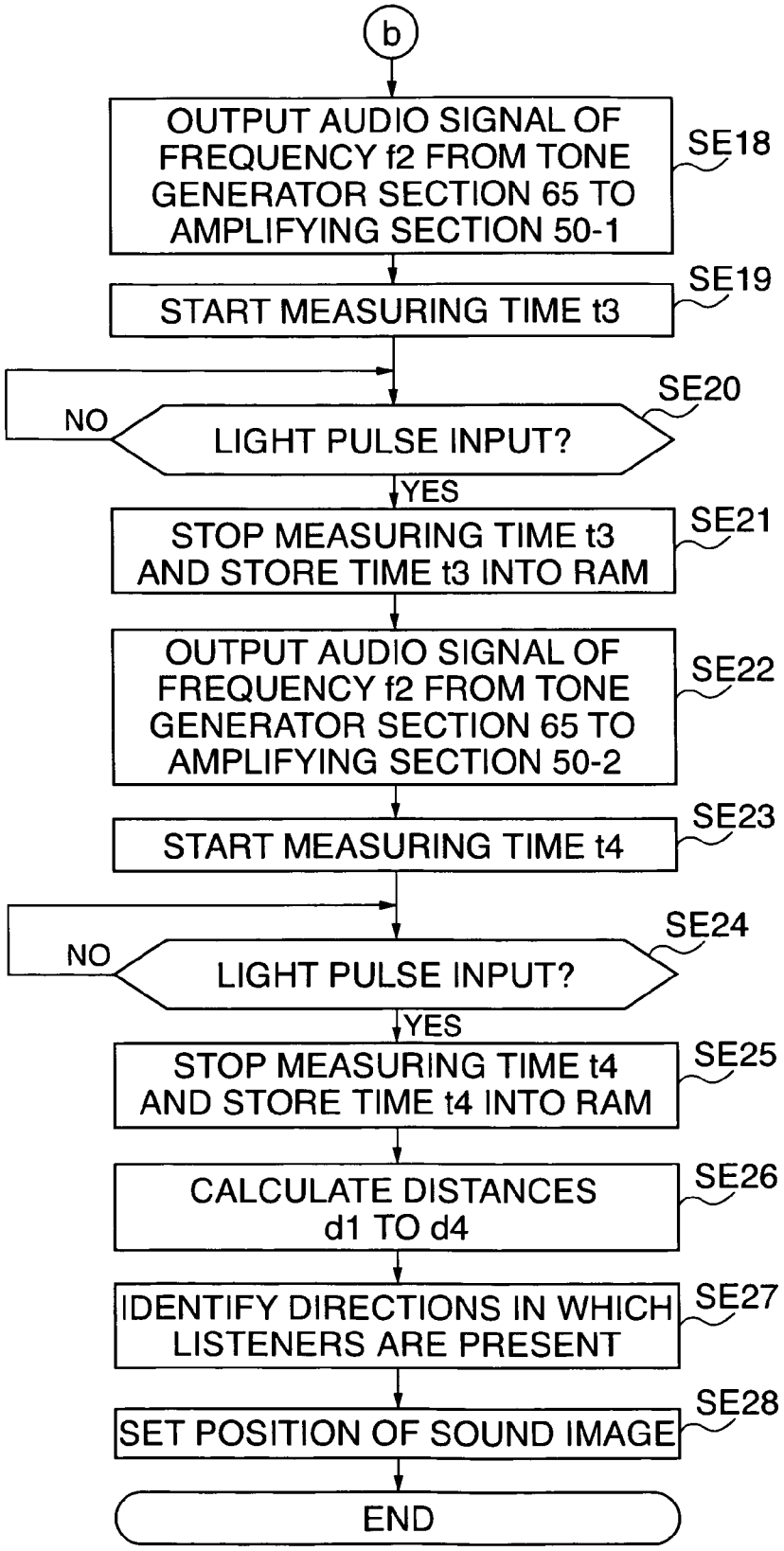
FIG. 20 is a flowchart of processing implemented by the control section of the system in FIG. 18.

Next, an operation of the system in FIG. 18 will be described with reference to FIGS. 19 and 20. FIGS. 19 and 20 are a flowchart of the processing for being implemented by the control section 10 of the system shown in FIG. 18. In the following, the operation will be given of a case where the distance d0 between the speakers 60-1, 60-2 is stored in the nonvolatile memory of the control section 10, the filter section 113 of the light-emission responder 100-1 permits a signal having a frequency f1 to pass therethrough, and the filter section 113 of the light-emission responder 100-2 permits a signal having a frequency f2 different from the frequency f1 to pass therethrough.

Referring to FIG. 19, the control section 10 first controls the tone generator section 65 to output an audio signal of frequency f1 to the amplifying section 50-1 (step SE10). The control section 10 starts measuring a time t1 elapsed from when the audio signal is output to the amplifying section 50-1 (step SE11). When the audio signal of frequency f1 is input to the amplifying section 50-1, a sound wave of frequency f1 is output from the speaker 60-1.

When the sound wave output from the speaker 60-1 reaches the light-emission responder 100-1, the sound wave is converted by the microphone 110 into an electrical signal. The electrical signal is amplified by the amplifying section 111 and is then output to the AGC section 112. In the AGC section 112, the supplied electrical signal is subjected to an amplitude adjustment such that the peak of the amplitude becomes constant. The amplitude-adjusted electrical signal is output to the filter section 113. The electrical signal of frequency f1 is output from the filter section 113 to the comparing section 114.

When the electrical signal of frequency f1 is output from the filter section 113, an "H" signal is output from the comparing section 114 as in the case of the first system, and a light pulse notifying that the sound wave of frequency f1 is input is output from the light-emission response control section 117. The sound wave output from the speaker 60-1 also reaches the light-emission responder 100-2. However, since the filter section 113 of the light-emission responder 100-2 does not permit the electrical signal of frequency f1 to pass therethrough, a light pulse is not output from the light-emission responder 100-2.

When the light pulse output from the light-emission responder 100-1 reaches the light receiving section 20, the light reaching the light receiving section 20 is converted into an electrical signal, which is output to the control section 10. When the electrical signal output from the light receiving section 20 is input into the control section 10 (YES to step SE12), the control section 10 stops measuring the time t1, and stores the measured time t1 into the RAM (step SE13).

Next, the control section 10 controls the tone generator section 65 to output the audio signal of frequency f1 to the amplifying section 50-2 (step SE14). The control section 10 starts measuring a time t2 elapsed from when the audio signal is output to the amplifying section 50-2 (step SE15). When the audio signal of frequency f1 is input into the amplifying section 50-2, a sound wave of frequency f1 is output from the speaker 60-2.

When the sound wave output from the speaker 60-2 reaches the light-emission responder 100-1, the light-emission responder 100-1 outputs a light pulse to notify that the sound wave of frequency f1 is input as in the case when the sound wave output from the speaker 60-1 reaches the light-emission responder 100-1. When the light pulse reaches the light receiving section 20, the light reaching the light receiving section 20 is converted into an electrical signal, which is output to the control section 10. When supplied with the electrical signal output from the light receiving section 20 (YES to step SE16), the control section 10 stops measuring the time t2 and stores the measured time t2 into the RAM (step SE17).

Next, as shown in FIG. 20, the control section 10 controls the tone generator section 65 to output the audio signal of frequency f2 to the amplifying section 50-1 (step SE18). The control section 10 starts measuring a time t3 elapsed from when the audio signal is output to the amplifying section 50-1 (step SE19). When the audio signal of frequency f2 is input into the amplifying section 50-1, a sound wave of frequency f2 is output from the speaker 60-1.

When the sound wave output from the speaker 60-1 reaches the light-emission responder 100-2, the light-emission responder 100-2 outputs a light pulse notifying that the sound wave of frequency f2 is input as in the case when the sound wave output from the speaker 60-1 reaches the light-emission responder 100-1. When the light pulse reaches the light receiving section 20, the light reaching the light receiving section 20 is converted into an electrical signal, which is output to the control section 10. When supplied with the electrical signal output from the light receiving section 20 (YES to step SE20), the control section 10 stops measuring the time t3 and stores the measured time t3 into the RAM (step SE21). The sound wave output from the speaker 60-1 also reaches the light-emission responder 100-1. However, since the filter section 113 of the light-emission responder 100-1 does not permit the electrical signal of frequency f2 to pass therethrough, a light pulse is not output from the light-emission responder 100-1.

Next, the control section 10 controls the tone generator section 65 to output the audio signal of frequency f2 to the amplifying section 50-2 (step SE22). The control section 10 starts measuring a time t4 elapsed from when the audio signal is output to the amplifying section 50-2 (step SE23). When the audio signal of frequency f2 is input to the amplifying section 50-2, a sound wave of frequency f2 is output from the speaker 60-2.

When the sound wave output from the speaker 60-2 reaches the light-emission responder 100-2, the light-emission responder 100-2 outputs a light pulse notifying that the sound wave of frequency f2 is input as in the case when the sound wave output from the speaker 60-1 reaches. When the light pulse reaches the light receiving section 20, the light reaching the light receiving section 20 is converted into an electrical signal, which is output to the control section 10. When supplied with the electrical signal output from the light receiving section 20 (YES to step SE24), the control section 10 stops measuring the time t4 and stores the measured time t4 into the RAM (step SE25).

Next, the control section 10 multiplies the time t1, i.e., the time required for the sound wave output from the speaker 60-1 to reach the light-emission responder 100-1, by the sound velocity to determine a distance d1 from the speaker 60-1 to the light-emission responder 100-1. The control section 10 multiplies the time t2, i.e., the time required for the sound wave output from the speaker 60-2 to reach the light-emission responder 100-1, by the sound velocity to determine a distance d2 from the speaker 60-2 to the light-emission responder 100-1. The control section 10 multiplies the time t3, i.e., the time required for the sound wave output from the speaker 60-1 to reach the light-emission responder 100-2, by the sound velocity to determine a distance d3 from the speaker 60-1 to the light-emission responder 100-2. The control section 10 multiplies the time t4, i.e., the time required for the sound wave output from the speaker 60-2 to reach the light-emission responder 100-2, by the sound velocity to determine a distance d4 from the speaker 60-2 to the light-emission responder 100-2 (step SE26).

Based on the distances d1, d2 and the stored distance d0 between the speakers 60-1, 60-2, the control section 10 determines an angle formed between the side connecting the speakers 60-1, 60-2 and the side connecting the speaker 60-1 and the light-emission responder 100-1. The control section 10 determines an angle formed between the side connecting the speakers 60-1, 60-2 and the side connecting the speaker 60-2 and the light-emission responder 100-1 on the basis of the distances d0 to d2. When these angles are determined, the control section 10 identifies the direction of the light-emission responder 100-1 as viewed from the speakers 60-1, 60-2. As in the case of determining the direction of the light-emission responder 100-1, the direction of the light-emission responder 100-2 as viewed from the speakers 60-1, 60-2 is determined based on the distances d0, d3, and d4 (step SE27).

Next, the control section 10 controls the pan control section 90-1 to divide the audio signal into the mixer sections 91-1, 91-2 based on the identified direction of the light-emission responder 100-1 such as to move the sound image localization of the audio signal input to the input terminal 30-1 toward the light-emission responder 100-1. The control section 10 controls the pan control section 90-2 to divide the audio signal into the mixer sections 91-1, 91-2 based on the identified direction of the light-emission responder 100-2 such as to move the sound image localization of the audio signal input to the input terminal 30-2 toward the light-emission responder 100-2 (step SE28). The audio signals are mixed in the mixer sections 91-1, 91-2, and amplified by the amplifying sections 50-1, 50-2 for output from the speakers 60-1, 60-2.

As described above, with this system, the positions of the listeners can be detected without requiring the listeners to perform a laborious operation, and the sound image can be localized at a proper position in accordance with the positions of the listeners without requiring the listeners to operate the speaker system. It should be noted that in this embodiment, each of the light-emission responders 100-1, 100-2 may include a light-emission response output section 116. When sound waves from the speaker 60R, 60L are input into the light-emission responders 100, radio waves may be output from the light-emission response output sections 116, with the light emitting elements being simply lightened. Radio wave receiving sections each receiving a radio wave may be connected to the control section 10 so as to receive radio waves output from the light-emission responders 100. Time periods from when sound waves are output to when radio waves are received may be measured, and the positions of the listeners may be identified.

In the above, the embodiments of this invention have been described. However, this invention is not limited to the above described embodiments, and can be embodied in various other forms as described below.

In the above described embodiments, the power supply of the light-emission responder may not be a solar battery, but may be a primary battery or a secondary battery. In the embodiments other than the fifth embodiment, sound waves may be output from a speaker array. Communication may be made between the control sections 10, 130, and a frequency range of a signal permitted to pass through the filter section 113 may be controlled from the control section 10 side. The reference voltage for use in the comparing section may also be controlled by means of communication.

In the above described embodiments, the light-emitting element 120 may be configured not to output visible light but output infrared light.

There may be set a plurality of frequency ranges in which a signal is able to pass through the filter section 113, and the wavelength of light output from the light-emitting element 120 may be changed in accordance with that frequency range in which the signal passes through the filter section. The amount of light output from the light emitting element 112 may be changed in accordance with the level of the signal passing through the filter section 113.

In the above described third embodiment, the distances d1, d2 are transmitted from the light-emission responder 100A to the control section 10. Alternatively, the times t1, t2 may be transmitted and the distances d1, d2 may be determined on the control section 10 side. The above described arrangement may be used in a wide area such as a concert hall, and sounds may be transmitted only to audiences seated at particular seats. In the above described embodiments, the sound wave output for the detection of the position of the light-emission responder may be within or outside an audible range. The light-emission responder may not include the filter section 113 but may be configured to output a light pulse in response to an electrical signal being output from the microphone 110.

The comparing section 114 may be set with a plurality of reference voltages for being compared with an electrical signal. Time periods required for the electrical signal to reach each of the reference voltages may be measured to determine a slew rate of the rise of the electrical signal, and the determined slew rate may be transmitted to the control section 10. In the comparing section 114, if the rise of the input electrical signal is not sharp, a time period of $\Delta t$ is required from when a sound wave is input to when the light-emitting element 120 is lightened. In the control section 10, the time period $\Delta t$ may be determined in accordance with the received slew rate, and the time period $\Delta t$ may be subtracted from the measured time t1 or t2 to thereby more accurately determine the time required for the sound wave to reach the light-emission responder 100. In that form, the distance from each speaker to the light-emission responder can be determined with accuracy.

In the above described embodiments, the light-emission responder is affixed to a human person, however, it may be affixed to or embedded in a chair on which a listener sits. With this form, a satisfactory acoustic field can be obtained, for example, at a location where a position detector is disposed, without the need of attachment and detachment of the position detector.

In the above described embodiments, the light-emission responder includes the AGC section 112. However, the AGC section 112 may not be included and the output of the amplifying section 111 may be input to the filter section 113.

INDUSTRIAL APPLICABILITY

According to this invention, a light-emission responder can be provided which responds to the input of sound, realizes a variety of forms of response, and can be used in a variety of forms of use.

The invention claimed is:

1. A speaker system comprising a plurality of light-emission responders and a speaker array, wherein each of said light-emission responders comprises:

a sound pickup section adapter to pick up sounds;

a level detecting section adapted to detect a level of sound belonging to a predetermined frequency range out of the sounds picked up by said sound pickup section;

a light emitting section adapted to emit light; and a light-emission control section adapted to allow said light emitting section to emit the light based on the level detected by said level detecting section, wherein said speaker array comprises:

a plurality of speaker units;

a delay section adapted to delay an input audio signal and output a delayed signal to each of the plurality of speaker units;

a delay amount control section adapted to control a delay amount of the audio signal delayed by said delay section;

an audio signal output section adapted to output the audio signal to said delay section;

a light detecting section adapted to detect the light emitted by respective light emitting sections in the plurality of light-emission responders;

a time measurement section adapted to measure a first time period elapsed from when a first speaker unit of the plurality of speaker units emits the sound to when said light detecting section detects the light, and a second time period elapsed from when a second speaker unit of the plurality of speaker units emits the sound to when said light detecting section detects the light; and a direction identifying section adapted to identify respective directions to the respective light-emission responders based on the first time period and the second time period measured by said time measurement section, wherein the predetermined frequency range for a first light-emission responder is a first predetermined frequency range and the predetermined frequency range for a second light-emission responder is a second predetermined frequency range different than the first predetermined frequency range, wherein said audio signal output section outputs an audio signal of a sound belonging to the first predetermined frequency range when said time measuring section measures the first time period and the second time period corresponding to the first light-emission responder, and outputs an audio signal of a sound belonging to the second predetermined frequency range when said time measuring section measures the first time period and the second time period corresponding to the second light-emission responder, and wherein said delay amount control section controls the delay amount for each of the audio signals output to said speaker units according to the directions identified by said direction identifying section.

2. The speaker system according to the claim 1, wherein said delay amount control section controls the delay amount such that acoustic beams are output in the respective directions to the respective light-emission responders.

* * * * *